US010737839B2

(12) United States Patent
Mooney

(10) Patent No.: US 10,737,839 B2
(45) Date of Patent: Aug. 11, 2020

(54) CANISTER AND BRACKET SYSTEM AND METHOD

(71) Applicant: PROFESSIONAL DISPOSABLES INTERNATIONAL, INC., Orangeburg, NY (US)

(72) Inventor: Michael Mooney, Florida, NY (US)

(73) Assignee: PROFESSIONAL DISPOSABLES INTERNATIONAL, INC., Orangeburg, NY (US)

( * ) Notice: Subject to any disclaimer, the term of this patent is extended or adjusted under 35 U.S.C. 154(b) by 156 days.

(21) Appl. No.: 15/542,351

(22) PCT Filed: Jan. 26, 2016

(86) PCT No.: PCT/US2016/014907

§ 371 (c)(1),
(2) Date: Jul. 7, 2017

(87) PCT Pub. No.: WO2016/123096

PCT Pub. Date: Aug. 4, 2016

(65) Prior Publication Data

US 2018/0273247 A1 Sep. 27, 2018

Related U.S. Application Data

(60) Provisional application No. 62/107,621, filed on Jan. 26, 2015.

(51) Int. Cl.

| | |
|---|---|
| ***B65D 25/22*** | (2006.01) |
| ***B65D 1/16*** | (2006.01) |
| ***B65D 1/40*** | (2006.01) |

(52) U.S. Cl.

CPC ..... *B65D 25/22* (2013.01); *B65D 1/16* (2013.01); *B65D 1/40* (2013.01); *B65D 2313/00* (2013.01)

(58) Field of Classification Search

CPC . B65D 25/22; B65D 1/16; B65D 1/40; B65D 2313/00; B60N 3/103

(Continued)

(56) References Cited

U.S. PATENT DOCUMENTS 3,212,660 A * 10/1965 Adell ..... B60S 1/50 215/383
3,533,526 A * 10/1970 Adell ..... B60N 3/103 215/10

(Continued)

FOREIGN PATENT DOCUMENTS

FR 1 106 958 A 12/1955

OTHER PUBLICATIONS

U.S. Appl. No. 29/520,705 (D. 785,464), filed Mar. 17, 2015 (May 2, 2017).

(Continued)

*Primary Examiner* — Eret C McNichols
(74) *Attorney, Agent, or Firm* — Baker Botts L.L.P.

(57) ABSTRACT

A canister and bracket system and method is disclosed. The system including a canister comprising a sidewall defining a first retaining section and a second retaining section disposed less than 180 degrees from the first retaining section and a bracket attachable with the canister. The bracket comprising a first holding feature, a second holding feature, and a connection portion that extends between the first holding feature and the second holding feature. The first holding feature is receivable in the first retaining section and is releasably engagable with the first retaining section of the canister and the second holding feature is receivable in second retaining section and is releasably engagable with the second retaining section of the canister. When the bracket is coupled with and supports the canister, the bracket interfaces with less than 180 degrees of the canister.

21 Claims, 24 Drawing Sheets

(58) Field of Classification Search
USPC ..... 215/399, 383, 384; 248/311.2, 313
See application file for complete search history.

(56) References Cited

U.S. PATENT DOCUMENTS 3,824,953 A 7/1974 Boone
3,837,595 A 9/1974 Boone
D233,385 S 10/1974 Friedman
3,986,479 A 10/1976 Bonk
D251,684 S 4/1979 Wood et al.
4,345,704 A 8/1982 Boughton
D284,941 S 8/1986 Porteous
4,735,317 A 4/1988 Sussman et al.
5,014,880 A 5/1991 Loesel, Jr. et al.
5,022,625 A 6/1991 Klinkhardt
5,105,958 A * 4/1992 Patton ..... A45F 3/16 215/14
5,145,139 A 9/1992 Holtsch
D329,963 S 10/1992 Schneider
D331,462 S 12/1992 Kraus et al.
5,215,211 A 6/1993 Eberle
5,226,625 A 7/1993 Hanna
5,251,777 A 10/1993 McMahon
D347,735 S 6/1994 Ziaylek, Jr. et al.
5,381,922 A 1/1995 Gladman et al.
D371,293 S 7/1996 Schoenmeyr
5,542,567 A 8/1996 Julius
5,549,074 A * 8/1996 Hui ..... A01K 1/0356 119/464
D377,756 S 2/1997 Beardsley
5,598,941 A 2/1997 Semersky et al.
5,669,329 A * 9/1997 Krause ..... A01K 1/0356 119/477
5,722,574 A 3/1998 Pratt
5,806,669 A 9/1998 Kim
D417,612 S 12/1999 Jones
6,003,703 A * 12/1999 Ruggeri ..... B65D 25/22 215/396
D420,587 S 2/2000 Cheng et al.
D425,425 S 5/2000 Silvers et al.
6,059,245 A 5/2000 Hermansen et al.
D429,152 S 8/2000 Lane
6,131,779 A 10/2000 Gendala
6,138,867 A 10/2000 Stelmack
D433,633 S 11/2000 La Fata
6,158,614 A 12/2000 Haines et al.
6,231,019 B1 5/2001 Broste
D444,069 S 6/2001 Bansal et al.
D448,672 S 10/2001 Cheng et al.
D448,674 S 10/2001 Mooney
6,523,690 B1 2/2003 Buck et al.
D472,813 S 4/2003 Wright
D473,142 S 4/2003 Beaver
6,585,130 B2 7/2003 Turbett et al.
6,592,004 B2 7/2003 Huang et al.
6,604,628 B1 8/2003 Tanaka et al.
D480,312 S 10/2003 Mungur et al.
D502,366 S * 3/2005 Strepkoff ..... 220/741
6,932,255 B2 8/2005 Van Houtte
D527,271 S 8/2006 Heisner et al.
D529,400 S 10/2006 Sellars
D530,224 S 10/2006 Mattesky
D530,617 S 10/2006 Little et al.
D538,663 S 3/2007 Kamineni et al.
D586,223 S 2/2009 Little et al.
D588,008 S 3/2009 Flanagan-kent et al.
D589,820 S 4/2009 Paal et al.
D591,600 S 5/2009 Dorn et al.
D625,194 S 10/2010 Thierjung et al.
D627,612 S 11/2010 Falk et al.
7,845,506 B2 * 12/2010 Willows ..... B65D 25/22 215/382
D636,266 S 4/2011 Walker et al.
8,128,045 B2 3/2012 Skaggs
D663,624 S 7/2012 Eble
8,313,005 B2 11/2012 Scarola
8,398,041 B2 3/2013 Brinkdopke et al.
D679,194 S 4/2013 Green
D702,832 S 4/2014 Hadley
D704,900 S 5/2014 Childs et al.
8,720,841 B2 5/2014 Morren et al.
8,727,244 B2 * 5/2014 Bernstein ..... A45F 3/16 222/215
8,783,508 B2 7/2014 Comerford
D711,776 S 8/2014 Iannello et al.
8,807,151 B2 8/2014 Büsing et al.
8,973,880 B2 3/2015 Goffman
D727,656 S 4/2015 Lim
D730,163 S 5/2015 Wu
D739,612 S 9/2015 Kronebusch
D742,213 S 11/2015 Sasanecki
9,210,992 B2 * 12/2015 deBeers ..... A45F 5/02
9,212,784 B2 12/2015 Frenal et al.
D750,476 S 3/2016 Huang
D750,773 S 3/2016 Eaton et al.
9,386,866 B2 * 7/2016 Presenty ..... A47B 96/1466
D786,051 S * 5/2017 Mooney ..... D8/373
2003/0057335 A1 3/2003 Roberts
2004/0108426 A1 6/2004 Turvey
2004/0168996 A1 9/2004 Jones
2006/0207963 A1 * 9/2006 Little ..... B65D 1/14 215/384
2006/0249528 A1 11/2006 Myers
2007/0012846 A1 1/2007 Wan
2007/0152120 A1 7/2007 Hostetler
2008/0029475 A1 * 2/2008 Scarola ..... B65D 23/102 215/398
2008/0197102 A1 * 8/2008 Farrar ..... B65D 41/06 215/335
2010/0243836 A1 9/2010 Gluck
2011/0001022 A1 1/2011 Edinger
2011/0042537 A1 2/2011 Fahldiek
2011/0079577 A1 * 4/2011 Guido ..... B65D 1/023 215/384
2011/0079603 A1 4/2011 Gordon
2012/0261537 A1 10/2012 Farrell et al.
2013/0043368 A1 2/2013 Hill
2013/0048667 A1 2/2013 Wieser
2013/0161346 A1 6/2013 Wolme et al.
2014/0069939 A1 3/2014 Sanguinet et al.
2014/0202982 A1 * 7/2014 Willows ..... A45F 5/021 215/384
2016/0167823 A1 * 6/2016 Gutekunst ..... B65D 1/0223 206/459.5

OTHER PUBLICATIONS

U.S. Appl. No. 29/520,713 (D. 782,315), filed Mar. 17, 2015 (Mar. 28, 2017).
U.S. Appl. No. 29/520,730 (D. 786,051), filed Mar. 17, 2015 (May 9, 2017).
U.S. Appl. No. 29/520,705, Mar. 20, 2017 Issue Fee Payment.
U.S. Appl. No. 29/520,705, Mar. 9, 2017 Notice of Allowance.
U.S. Appl. No. 29/520,705, Mar. 9, 2017 Applicant Initiated Interview Summary.
U.S. Appl. No. 29/520,705, Feb. 1, 2017 Response after Final Action.
U.S. Appl. No. 29/520,705, Dec. 1, 2016 Final Office Action.
U.S. Appl. No. 29/520,705, Sep. 30, 2016 Response to Non-Final Office Action.
U.S. Appl. No. 29/520,705, Jul. 1, 2016 Non-Final Office Action.
U.S. Appl. No. 29/520,705, Apr. 29, 2016 Response to Restriction Requirement.
U.S. Appl. No. 29/520,705, Mar. 23, 2016 Restriction Requirement.
U.S. Appl. No. 29/520,713, Mar. 22, 2016 Restriction Requirement Filed.
U.S. Appl. No. 29/520,713, Dec. 8, 2016 Notice of Allowance.
U.S. Appl. No. 29/520,713, Feb. 7, 2017 Issue Fee Payment.
U.S. Appl. No. 29/520,713, Sep. 30, 2016 Response to Non-Final Office Action.

(56) References Cited

OTHER PUBLICATIONS

U.S. Appl. No. 29/520,713, Dec. 7, 2016 Response after Final Action.
U.S. Appl. No. 29/520,713, Oct. 7, 2016 Final Office Action.
U.S. Appl. No. 29/520,713, Jun. 30, 2016 Non-Final Office Action.
U.S. Appl. No. 29/520,713, Apr. 29, 2016 Response to Restriction Requirement.
U.S. Appl. No. 29/520,730, Mar. 20, 2017 Issue Fee Payment.
U.S. Appl. No. 29/520,730, Mar. 9, 2017 Notice of Allowance.
U.S. Appl. No. 29/520,730, Feb. 3, 2017 Response after Final Action.
U.S. Appl. No. 29/520,730, Jan. 30, 2017 Advisory Action.
U.S. Appl. No. 29/520,730, Dec. 7, 2016 Response after Final Action.
U.S. Appl. No. 29/520,730, Oct. 7, 2016 Final Office Action.
U.S. Appl. No. 29/520,730, Jul. 7, 2016 Response to Non-Final Office Action.
U.S. Appl. No. 29/520,730, Apr. 11, 2016 Non-Final Office Action.
AutoZone. Ford Aspire 1994-1998 Repair Guide. 1998. Retrieved on [Sep. 28, 2016]. Retrieved from <URL: http://www.autozone.com/repairguides/Ford-Aspire-1994-1998-RepairGuide/EMISSION-CONTROLS/Evaporative-Emission-Controls//P0900c15280079a8c>; figures 3, 12; p. 5, "Removal and Installation".
International Search Report and Written Opinion dated Apr. 7, 2016 in International Application No. PCT/US16/014907.
Supplementary European Search Report dated Aug. 14, 2018 in Application No. EP 16743955.

* cited by examiner

SECTION C-C

TOP VIEW 501
510

501
510

501
510

501
510

501
510
SECTION A-A 501
600
502
A
A
503

512
510
511
522
520
521
532
531
520
510

CANISTER AND BRACKET SYSTEM AND METHOD

CROSS-REFERENCE TO RELATED APPLICATION

This application is a U.S. National Stage Patent Application under 35 U.S.C. § 371 of International Application No. PCT/US2016/014907, filed on Jan. 26, 2016, which claims priority to and the benefit of U.S. Provisional Patent Application Ser. No. 62/107,621, filed Jan. 26, 2015, the contents of each of which are hereby incorporated by reference in its their entirety herein.

FIELD

The disclosed subject matter relates to a canister and bracket system and a method for releasably mounting a canister with a bracket.

BACKGROUND

Containers, such as boxes, packets, or canisters, can be used to house and dispense articles. Certain containers can be fixedly mounted to surfaces, such as walls, doors, or carts. However, such containers can be difficult to remove and replace once the articles are depleted.

Other containers can be disposable. Such disposable containers can be free standing or stored or mounted using, for example, a container holder, cage, support bracket, or the like. Certain support brackets, such as metal support brackets, can include a flat horizontal support surface on which the disposable container can be placed and rested. Additionally, some support brackets typically have components that surround most of the container to limit movement thereof and secure the container within the support bracket. Unfortunately, such metal support brackets can be relatively heavy and expensive as compared with disposable containers. Moreover, metal support brackets and particularly those with a horizontal support surface, project outward from the surface on which the bracket is mounted. As such, a person or object moving past the rigid bracket can collide with the bracket causing harm or damage.

Accordingly, there remains a continued need for an efficient and economic system for a canister and bracket assembly. The presently disclosed subject matter satisfies these and other needs.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

In accordance with an aspect of the disclosed subject matter, a canister and bracket system is provided. The system includes a canister comprising a sidewall defining a first retaining section and a second retaining section disposed less than 180 degrees from the first retaining section with respect to an outer circumferential boundary of the canister; and a bracket attachable with the canister. The bracket includes a first holding feature, a second holding feature, and a connection portion that extends between the first holding feature and the second holding feature. The first holding feature is receivable in the first retaining section and is releasably engagable with the first retaining section of the canister and the second holding feature is receivable in second retaining section and is releasably engagable with the second retaining section of the canister. When the bracket is coupled with and supports the canister, the bracket interfaces with less than 180 degrees of the canister about the outer circumferential boundary.

In accordance with another aspect of the disclosed subject matter, a method for releasably mounting a canister with a bracket is disclosed. The method includes providing a canister comprising a sidewall defining a first retaining section and a second retaining section disposed less than 180 degrees from the first retaining section with respect to an outer circumferential boundary of the canister. The method further includes providing a bracket comprising a first holding feature, a second holding feature, and a connection portion that extends between the first holding feature and the second holding feature. The method further includes coupling the canister with the bracket such that the first holding feature is receivable in the first retaining section and is releasably engagable with the first retaining section and the second holding feature is receivable in second retaining section and is releasably engagable with the second retaining section, wherein when the bracket is coupled with and supports the canister the bracket interfaces with than 180 degrees of the canister about the outer circumferential boundary.

In accordance with another aspect of the disclosed subject matter, A canister is disclosed. The canister comprises a base surface; and a sidewall coupled to the base surface. The sidewall defines a first retaining section and a second retaining section disposed less than 180 degrees from the first retaining section with respect to an outer circumferential boundary of the canister. The first retaining section and second retaining section are respectively grippable by at least one of a thumb and fingers of a person or a first holding feature and a second holding feature of a bracket. 23. In accordance with another aspect of the disclosed subject matter, a bracket is disclosed. The bracket includes a first holding feature and a second holding feature, wherein the first holding feature is receivable in a first retaining section of a canister and is releasably engagable with the first retaining section of the canister and the second holding feature is receivable in a second retaining section and is releasably engagable with the second retaining section of the canister. A connection portion is coupled to and extending between the first holding feature and the second holding feature. A first tab is coupled to the first holding feature and a second tab is coupled to the second holding feature. Movement of the first and second tabs alters the configuration of the first holding feature and the second holding feature to disengage a canister coupled to the bracket therefrom, wherein when the bracket is coupled with and supports the canister the bracket interfaces with less than 180 degrees of the canister about an outer circumferential boundary of the canister.

It is to be understood that both the foregoing general description and the following detailed description are examples and are provided for purpose of illustration and not intended to limit the scope of the disclosed subject matter in any manner.

The accompanying drawings, which are incorporated in and constitute part of this specification, are included to illustrate and provide a further understanding of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to the various exemplary embodiments of the disclosed subject matter, exemplary embodiments of which are illustrated in the accompanying drawings. The systems and corresponding methods of the disclosed subject matter will be described in conjunction with the detailed description of the canister and bracket.

The system, method, and devices presented herein can be used to mount a container, such as a canister, to a bracket that is secured to a surface, such as a wall or an intravenous (IV) pole. For example, the disclosed subject matter is particularly suitable for coupling a disposable plastic container for dispensing articles, such as sanitizing wipes, with a plastic bracket that is secured to a wall or an IV pole.

Figure 7:
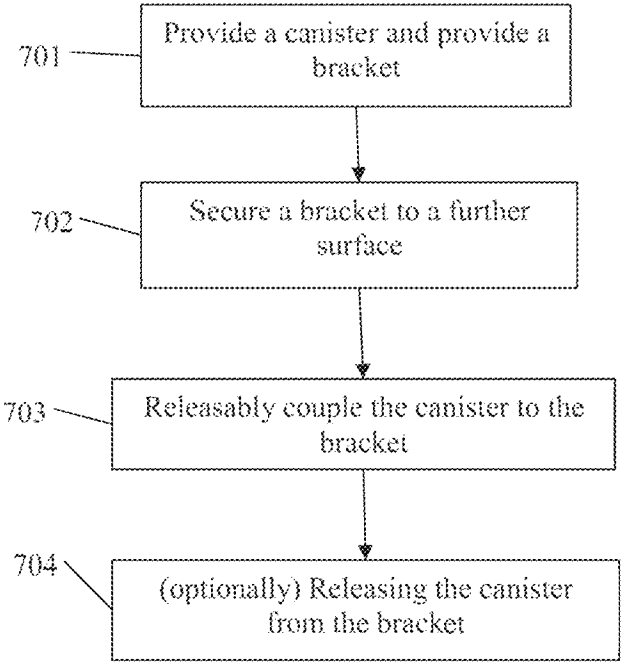
FIG. 7 presents a flow chart illustrating a representative method implemented with any of the disclosed canister and bracket assembly systems, according to an illustrative embodiment of the disclosed subject matter.

The accompanying figures, where like reference numerals refer to identical or functionally similar elements throughout the separate views, serve to further illustrate various embodiments and to explain various principles and advantages, in accordance with the disclosed subject matter. For purpose of explanation and illustration, and not limitation, a representative canister in accordance with the disclosed subject matter is shown in FIGS. 1A-1I. A second representative canister in accordance with the disclosed subject matter is shown in FIGS. 2A-2K. A third representative canister in accordance with the disclosed subject matter is shown in FIGS. 3A-3J. A representative bracket in accordance with the disclosed subject matter is shown in FIGS. 4A-4E. A representative lid in accordance with the disclosed subject matter is shown in FIGS. 5A-5G. A second representative lid in accordance with the disclosed subject matter is shown in FIGS. 6A-6G. A flow chart illustrating representative methods implemented in accordance with the disclosed subject matter is shown in FIG. 7. For purpose of illustration and not limitation, the systems and methods are described in conjunction with each other.

The system, device and method described herein are suitable for use with a wide variety of containers and brackets. However, for purpose of understanding, reference is made to canisters for dispensing articles such as germicidal disposable wipes or hand sanitizing wipes. Representative embodiments of canister and bracket systems according to the disclosed subject matter are depicted in FIGS. 1A-4E. A first embodiment of a canister and bracket system 10 is provided in FIGS. 1A-1H. As shown in FIGS. 1A-1H, a canister 100 is shown that includes a sidewall 101 and a base portion 140. As shown, the canister has an open top for receiving articles, such as sanitizing wipes. The canister can have any suitable shape, such as generally tubular as shown.

For example and not limitation, as shown in FIGS. 1A-1C and 1F-1G (and FIGS. 2A-C, 2F-H, 3A-C, and 3F-H), the canister 100 can optionally include a finished portion 130 at a first end of the sidewall 101 opposite the base portion 140 at a second end of the sidewall 101. The finish portion 130 can include at least one of a ridge, a threaded portion, or a protrusion, but other finishes as known in the art are contemplated herein. For example, the finish portion 130 of each of representative canister 100, 200, 300 is shown with a ridge 131. The canister can further include a lid 500, 600, which can be coupled to the first end of the sidewall 101 and is depicted in FIGS. 5A-5G and 6A-6G, as further discussed herein.

Figure 1A:
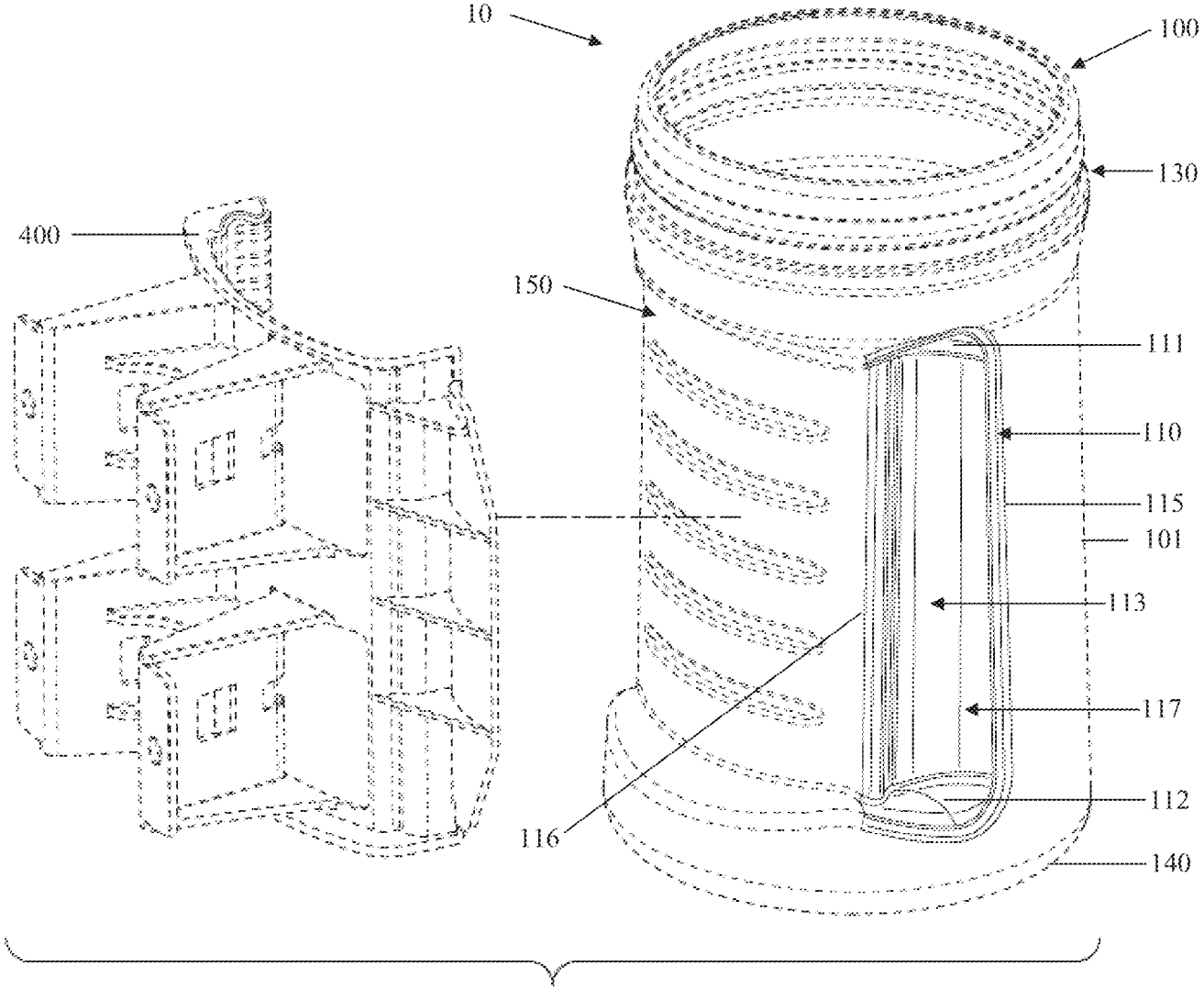
FIG. 1A is a perspective view of a representative canister and bracket assembly system prior to attachment thereof, according to an illustrative embodiment of the disclosed subject matter.
Figure 1B:
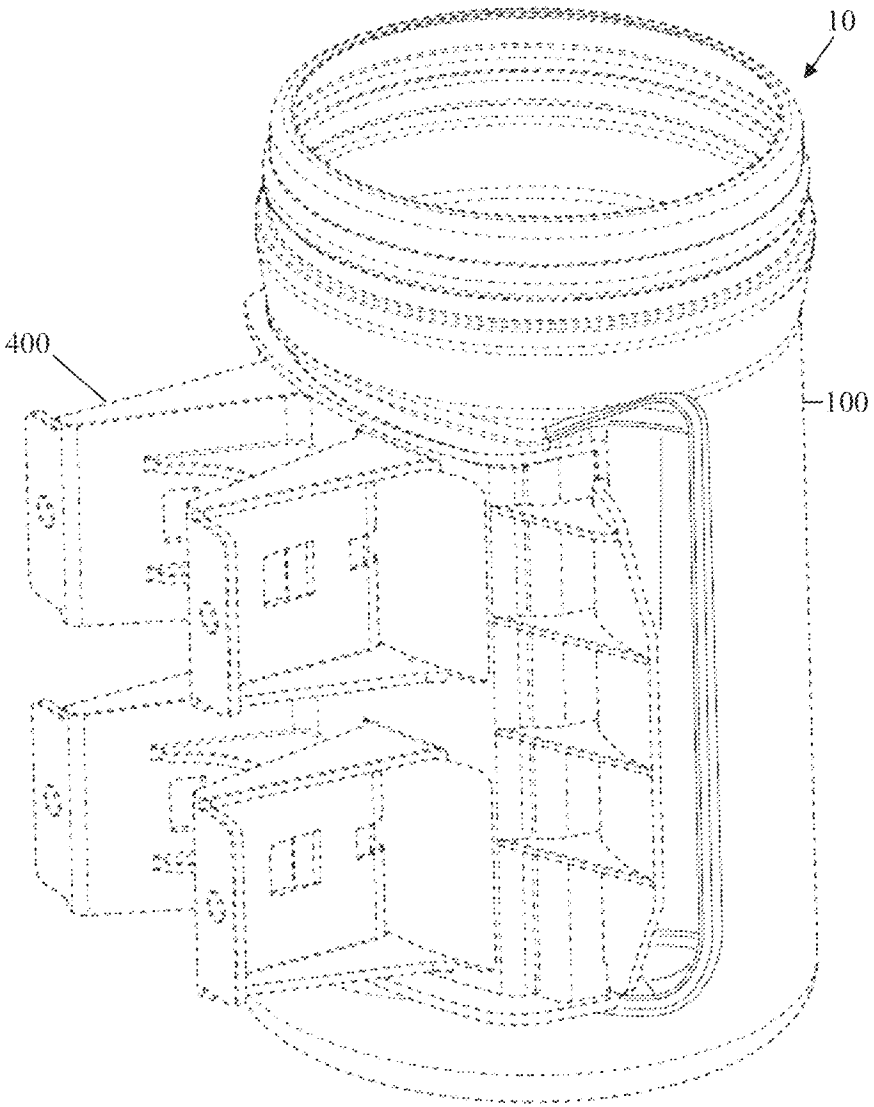
FIG. 1B is a perspective view of the canister and bracket assembly of FIG. 1A as coupled together.
Figure 1E:
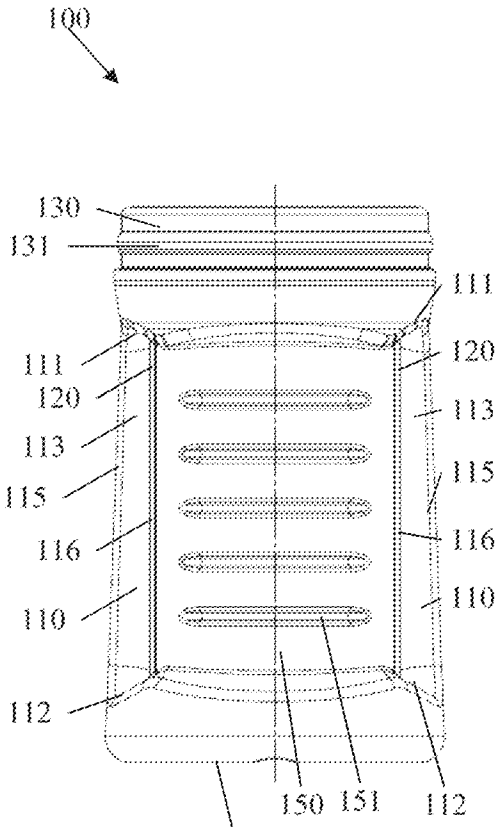
FIG. 1E is a rear view of the representative canister of FIG. 1A.

As best depicted in FIG. 1E, the sidewall of the canister defines two retaining sections 110. The two retaining sections 110 can be disposed less than 180 degrees apart along an outer circumferential boundary of the canister, as further discussed herein with relation to FIG. 2K.

A second embodiment of a canister and bracket system 20 is provided in FIGS. 2A-2K and a third embodiment of a canister and bracket system 30 is provided in FIGS. 3A-3J. As shown in FIGS. 2A-2K, the canister 200 is similar to the canister 100 of FIGS. 1A-1H, except that dimensions of certain features of the canister are different. For example, the canister 200 includes a greater internal holding volume and differing height, width, and depth dimensions than the canister 100, amongst other features. Similarly with respect to the canister and bracket system 30 of FIGS. 3A-3J, the canister 300 is similar to the canisters 100 and 200 depicted in FIGS. 1A-1H and 2A-2K, respectively, except that dimensions of the canister itself is different, such that the canister 300 includes a greater internal holding volume and differing height, width, and depth dimensions than the canisters 100, 200, amongst other features. For purpose of illustration and understanding, the following description will make reference to the canister 100 of FIGS. 1A-H. However, the systems and methods described herein can also apply to the canisters 200, 300 of FIGS. 2A-3J, unless otherwise stated.

According to an embodiment of the disclosed subject matter, the retaining sections 110 of the canisters 100, 200, and 300 remain consistent and uniform in dimension such that any sized canister 100, 200, 300 can be coupled with the same dimensioned bracket, as further discussed herein. In another embodiment, the retaining sections of the canisters 100, 200, 300 can be designed to interface with uniquely sized brackets for a given canister dimension.

Figure 1D:
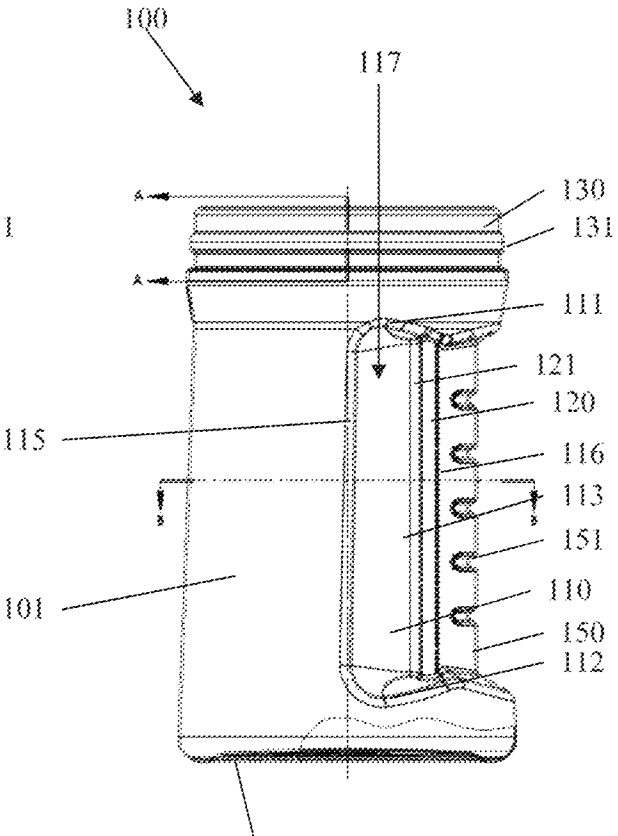
FIG. 1D is a side view of the representative canister of FIG. 1A.
Figure 1C:
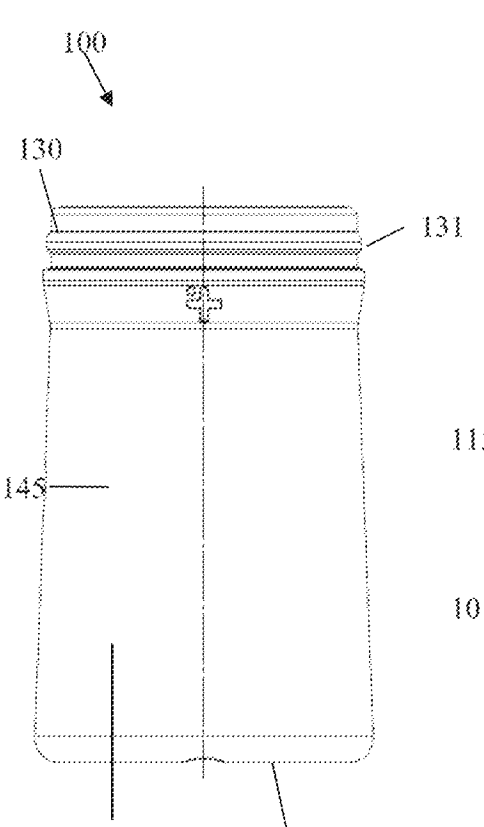
FIG. 1C is a front view of the representative canister of FIG. 1A.
Figure 1F:
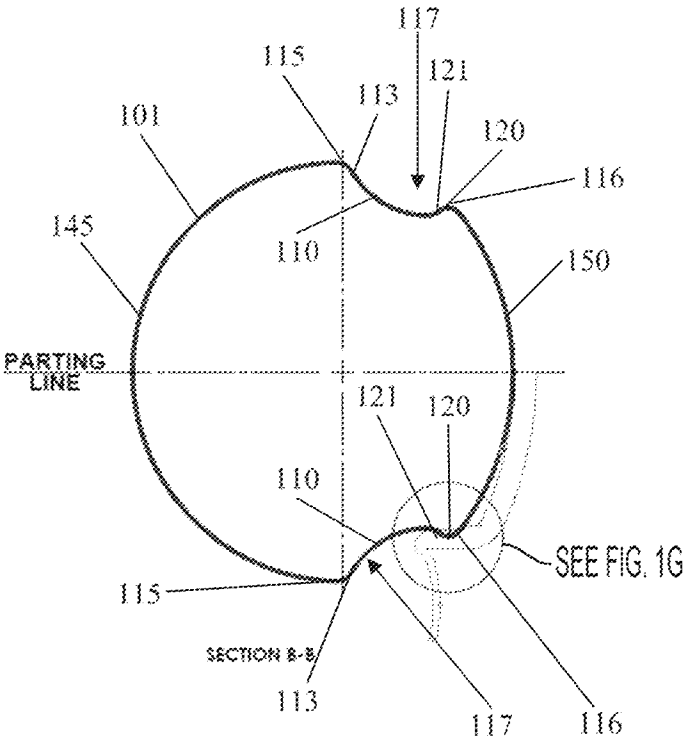
FIG. 1F is a cross-sectional view along the line B-B of the representative canister of FIG. 1D with the representative bracket of FIG. 1D partially depicted.
Figure 1G:
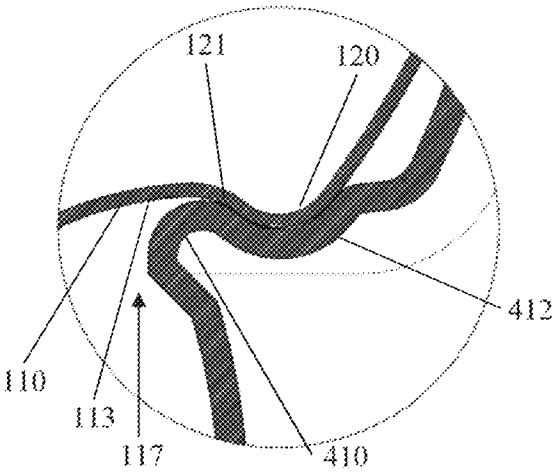
FIG. 1G is a detail view of the section indicated by the circle in FIG. 1F.
Figure 1H:
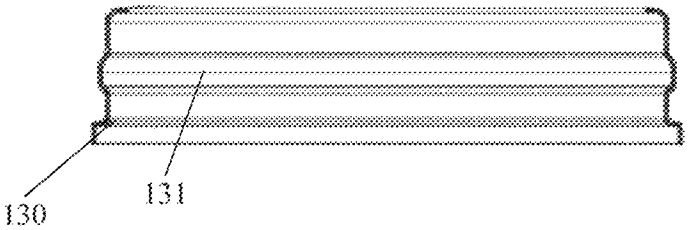
FIG. 1H is a cross-sectional view along the line A-A of the representative canister of FIG. 1D.
Figure 1I:
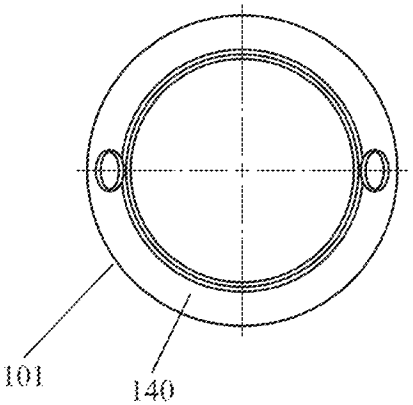
FIG. 1I is a bottom view of the representative canister of FIG. 1A.

As best shown in FIGS. 1C and 1E, the canister 100 further can include a front face 145 and a rear face 150. The front and rear faces can accommodate a label identifying the contents of the canister therein. Although both the front and rear faces are disposed between the first and second retaining sections 110, the rear face 150 has a surface area that is less than a surface area of the front face. The front and rear faces can additionally include structure features to enhance flexibility, rigidity, and/or structural integrity of the canister. For instance, for purposes of example, the front face 145 of FIG. 1C includes a smooth surface, whereas the rear face 150 of FIG. 1E includes a plurality of ridges 151, as shown. It is appreciated that either front or rear faces can include a smooth surface, an uneven surface, and various features such as ridges or the like, as known in the industry.

As best depicted in FIGS. 1A, 1D, and 1E (and correspondingly FIGS. 2A, 2D, 2E, 3A, 3D, and 3E), the first and second retaining sections 110 of the canister respectively include a front edge 115 and a rear edge 116. The front edge 115 of each retaining section is disposed adjacent the front face 145 of the canister, whereas the rear edge 116 of each retaining section 110 is disposed adjacent the rear face 150 of the canister.

Figure 2A:
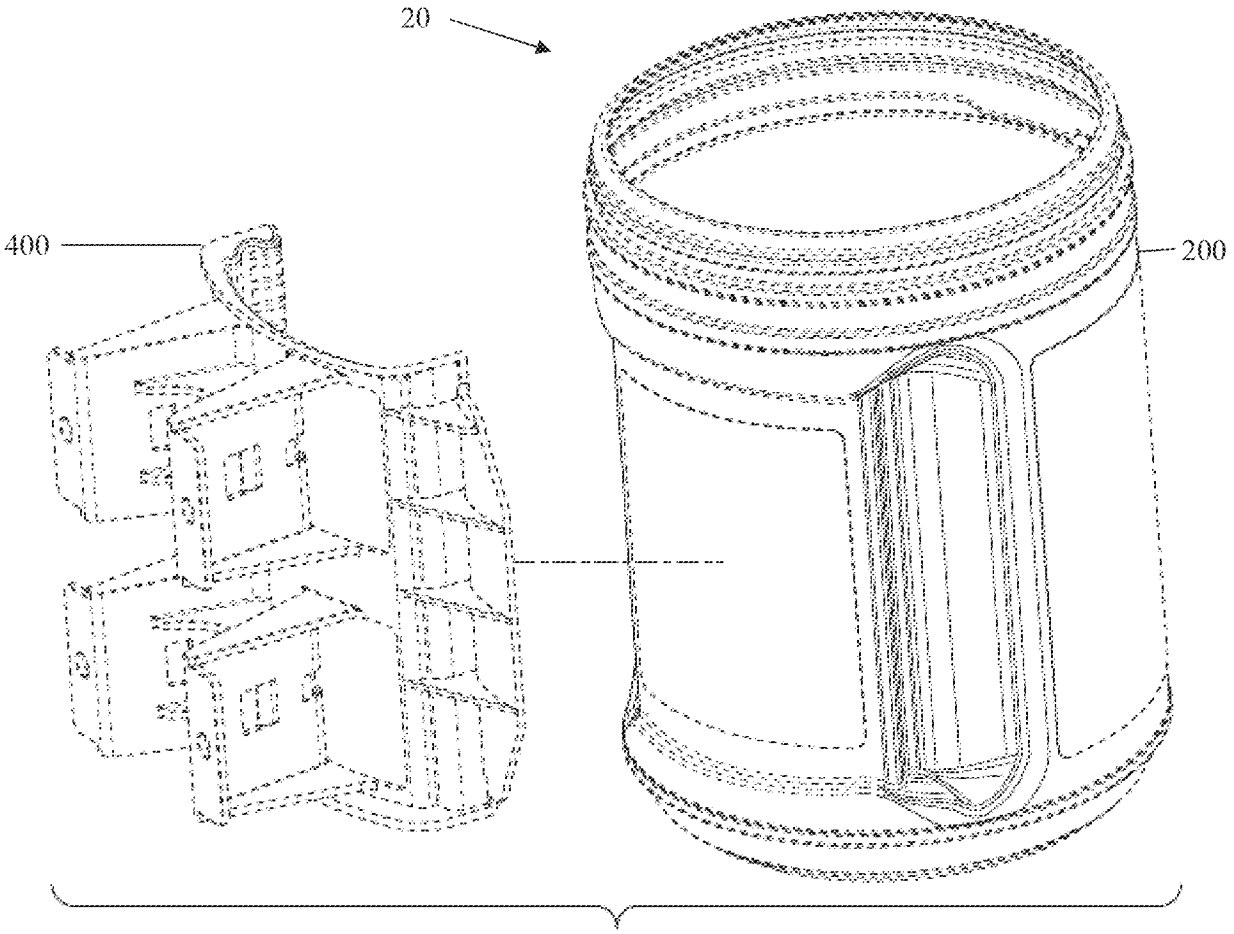
FIG. 2A is a perspective view of a representative canister and bracket assembly prior to attachment thereof, according to another illustrative embodiment of the disclosed subject matter.
Figure 2B:
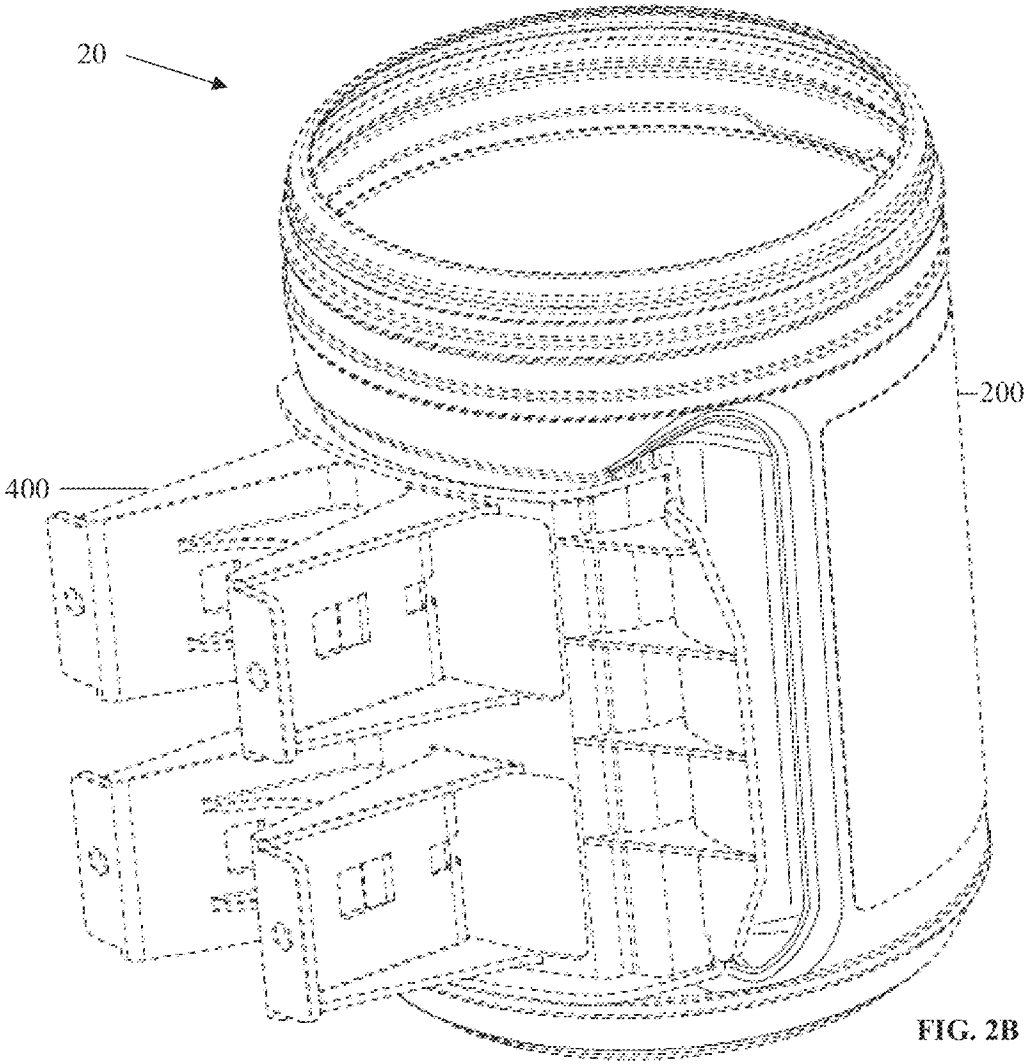
FIG. 2B is a perspective view of the canister and bracket assembly of FIG. 2A as coupled together.
Figure 2E:
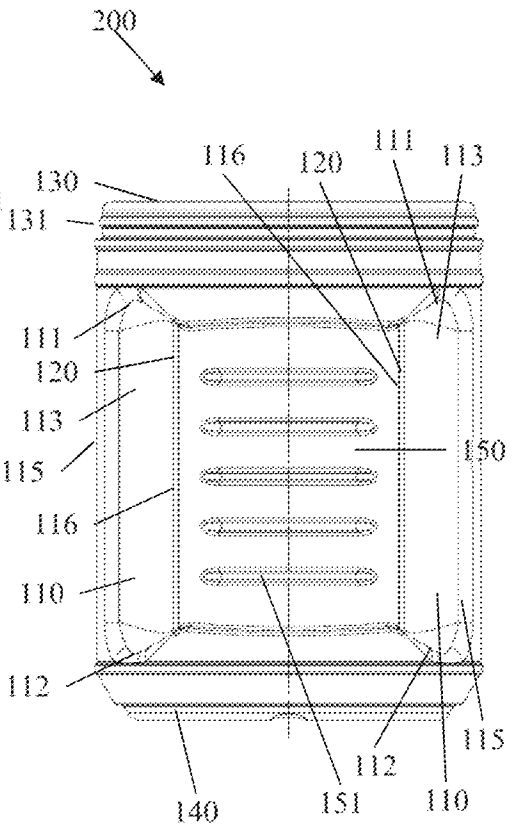
FIG. 2E is a rear view of the representative canister of FIG. 2A.
Figure 2D:
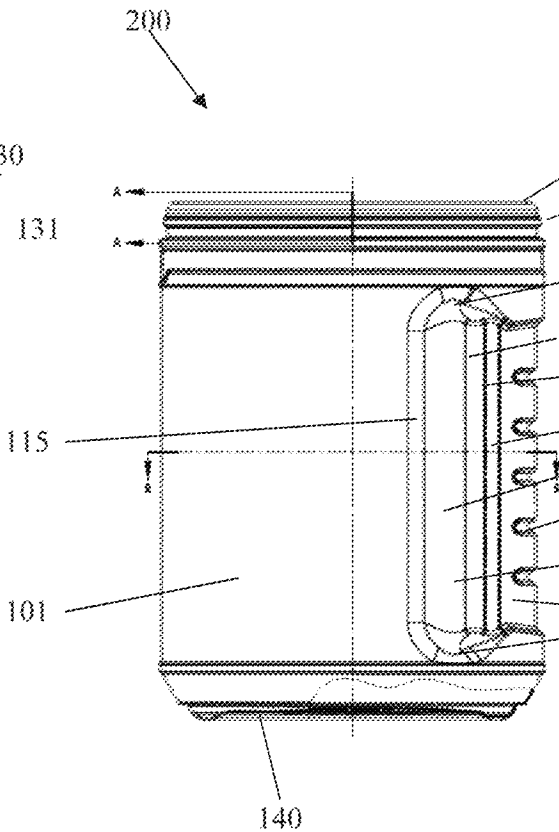
FIG. 2D is a side view of the representative canister of FIG. 2A.
Figure 2C:
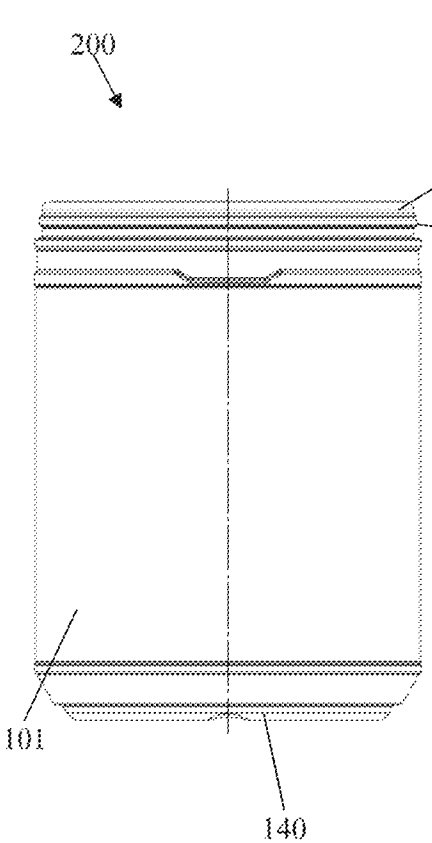
FIG. 2C is a front view of the representative canister of FIG. 2A.
Figure 2F:
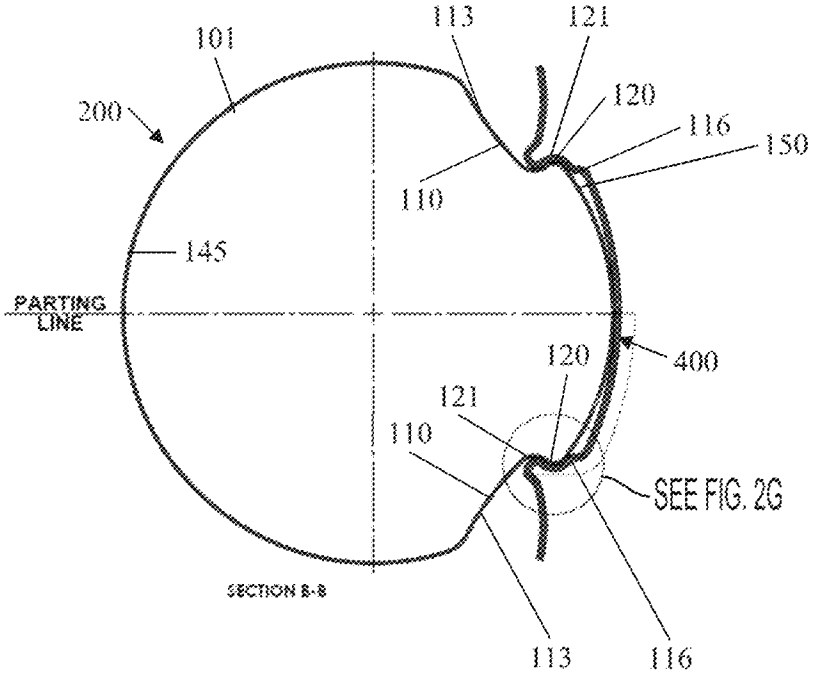
FIG. 2F is a cross-sectional view along the line B-B of the representative canister and bracket of FIG. 2D.
Figure 2G:
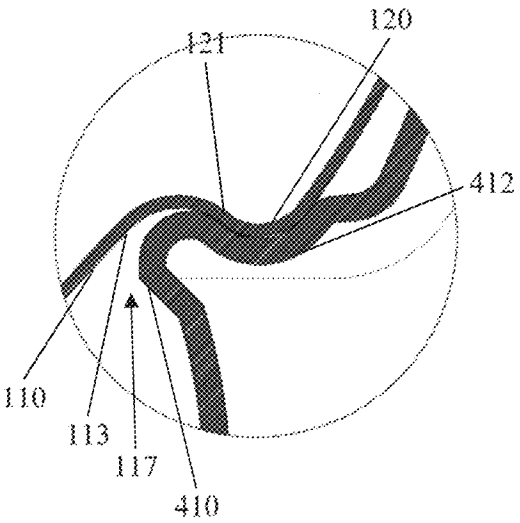
FIG. 2G is a detail view of the section indicated by the circle in FIG. 2F.
Figure 2H:
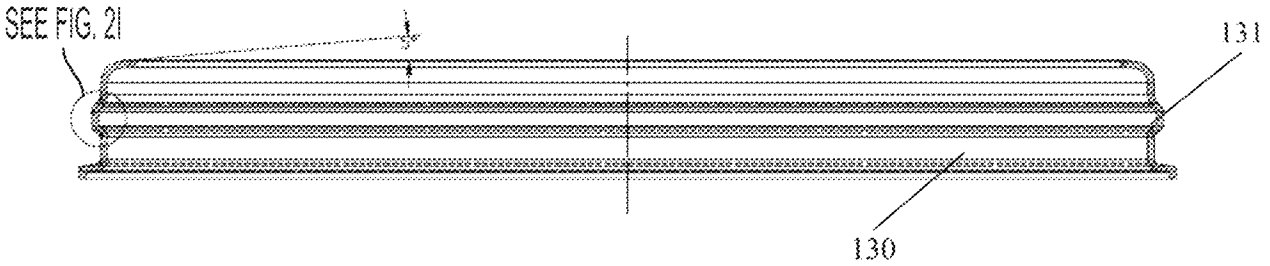
FIG. 2H is a cross-sectional view along the line A-A of the representative canister of FIG. 2D.
Figure 2I:
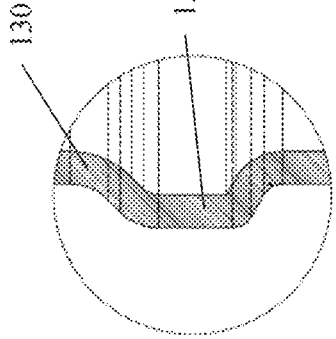
FIG. 2I is a detail view of the section indicated by the circle in FIG. 2H.
Figure 2J:
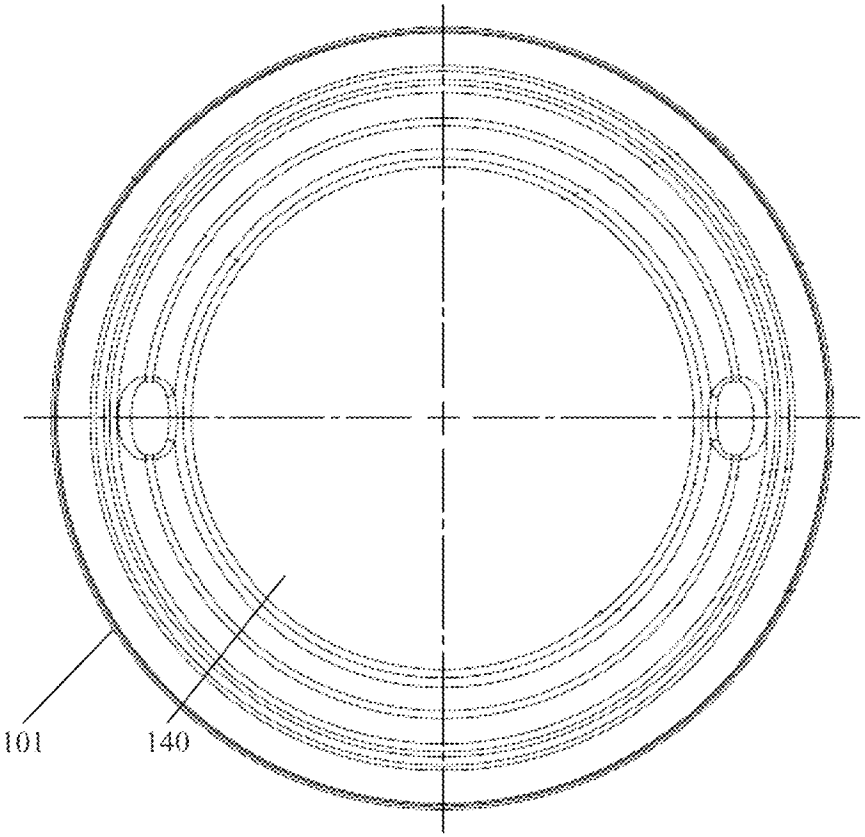
FIG. 2J is a bottom view of the representative canister of FIG. 2A.
Figure 2K:
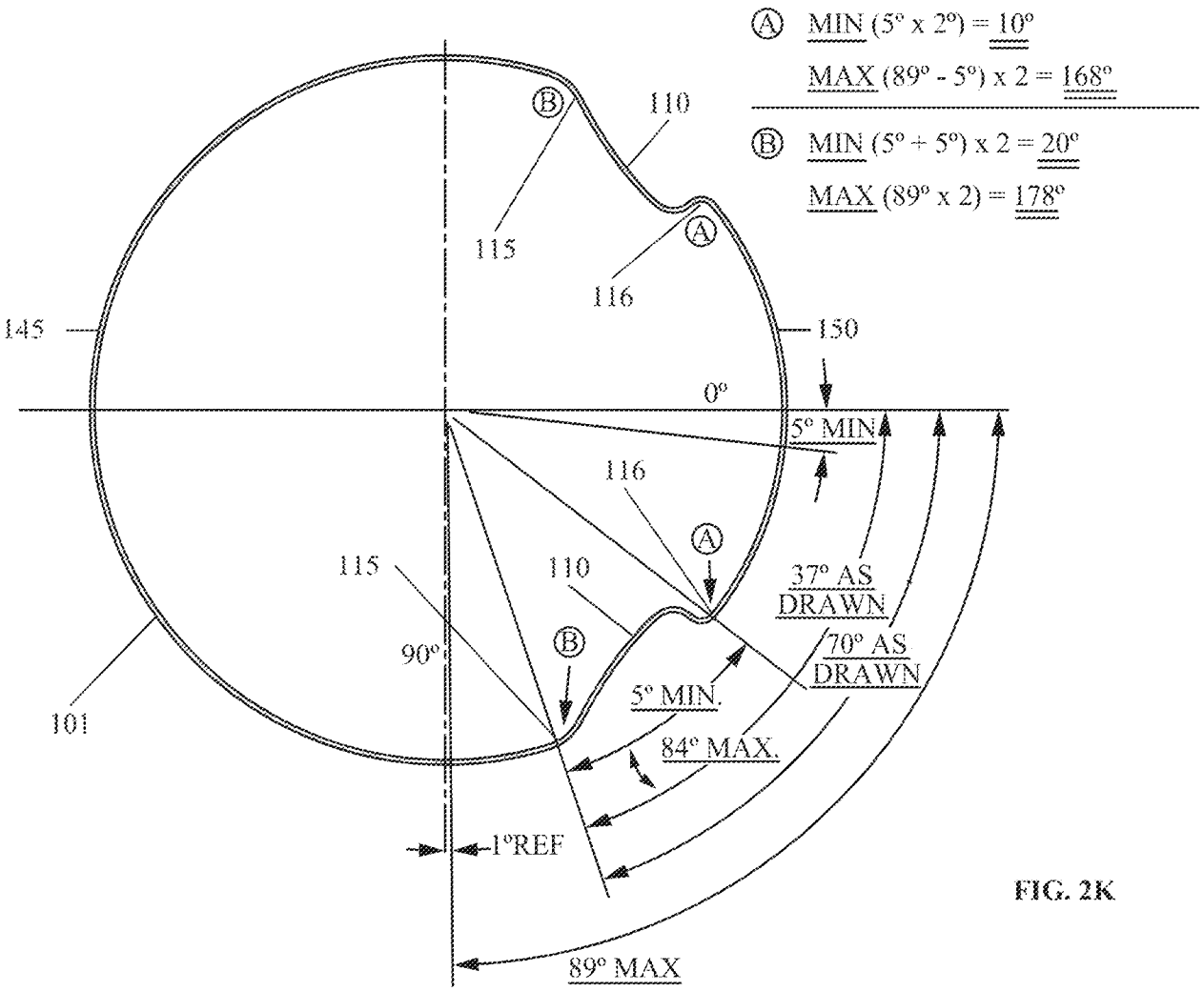
FIG. 2K is a cross-sectional view along the line B-B of the representative canister of FIG. 2D.
Figure 3A:
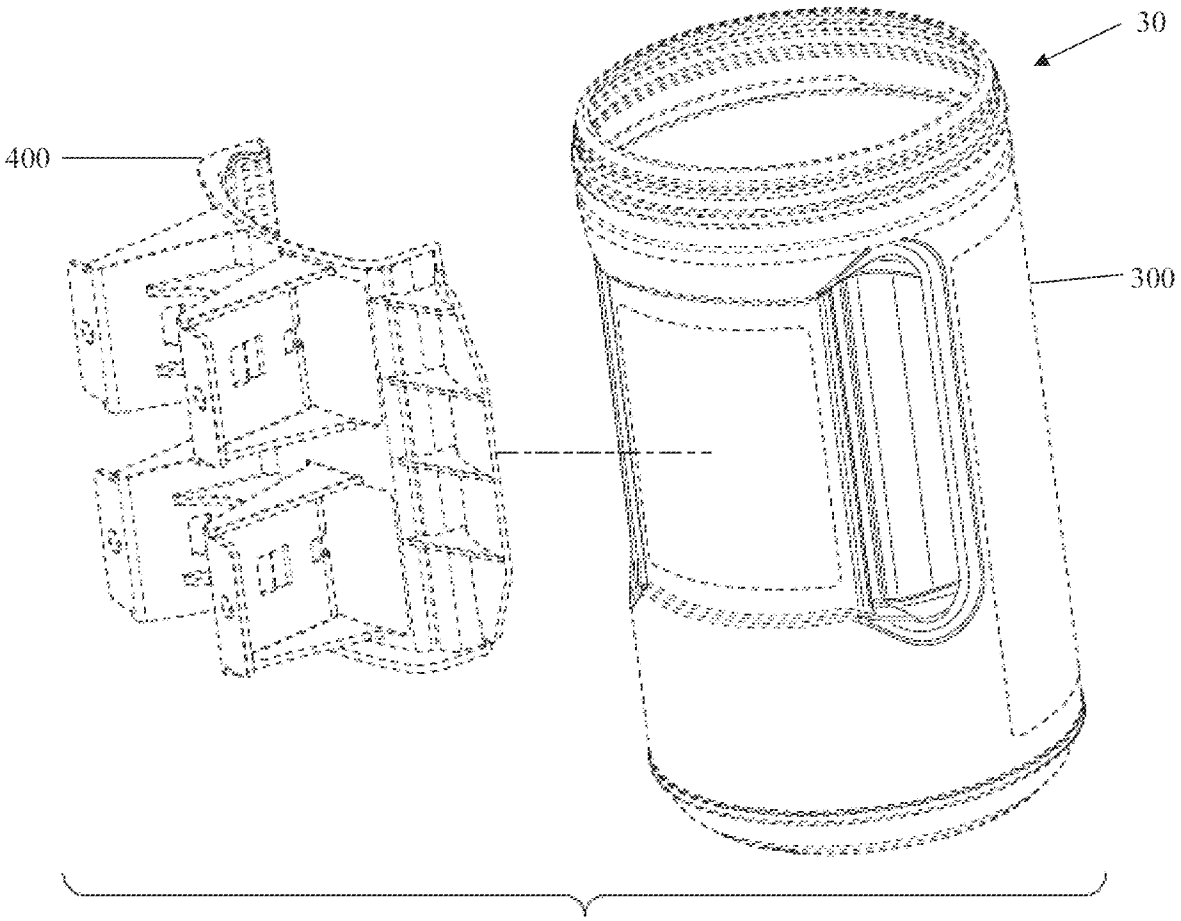
FIG. 3A is a perspective view of a representative canister and bracket assembly prior to attachment thereof, according to another illustrative embodiment of the disclosed subject matter.
Figure 3B:
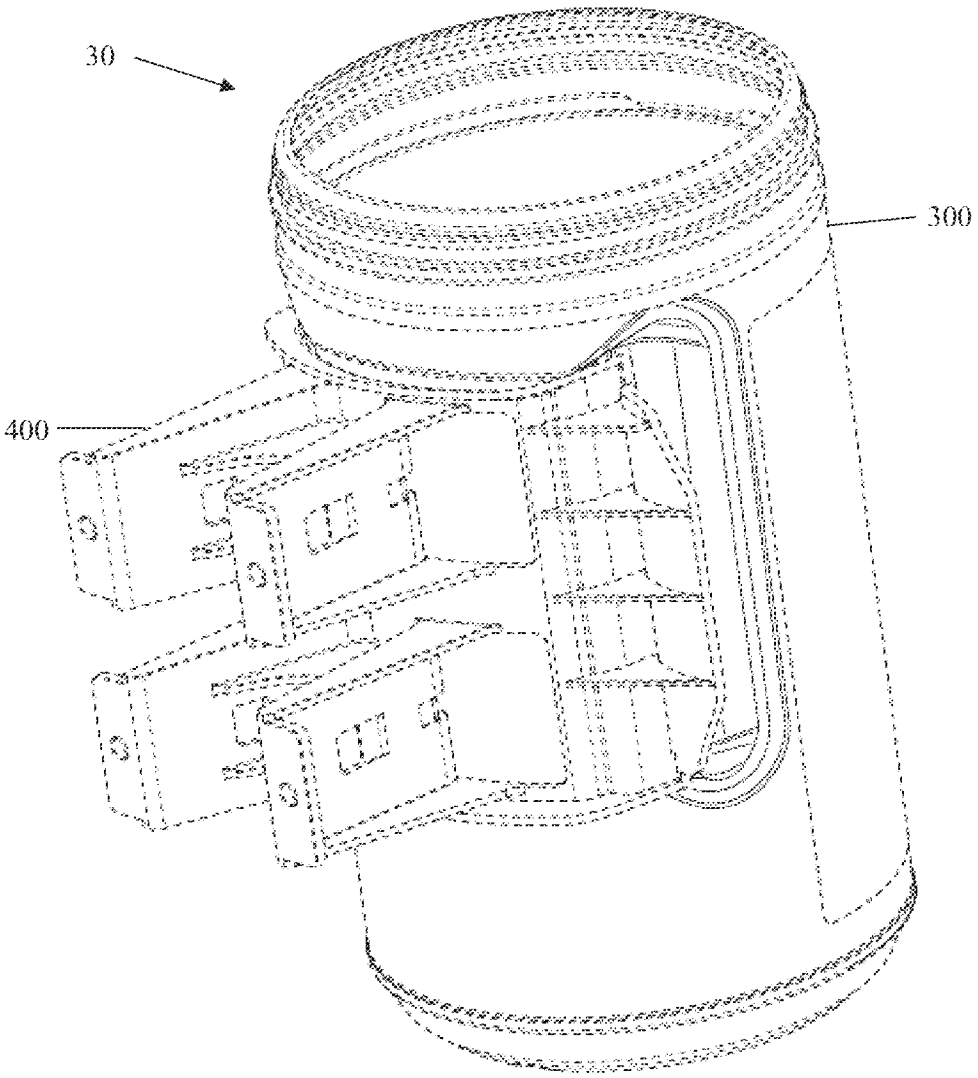
FIG. 3B is a perspective view of the canister and bracket assembly of FIG. 3A as coupled together.
Figures 3C, 3D, 3E:
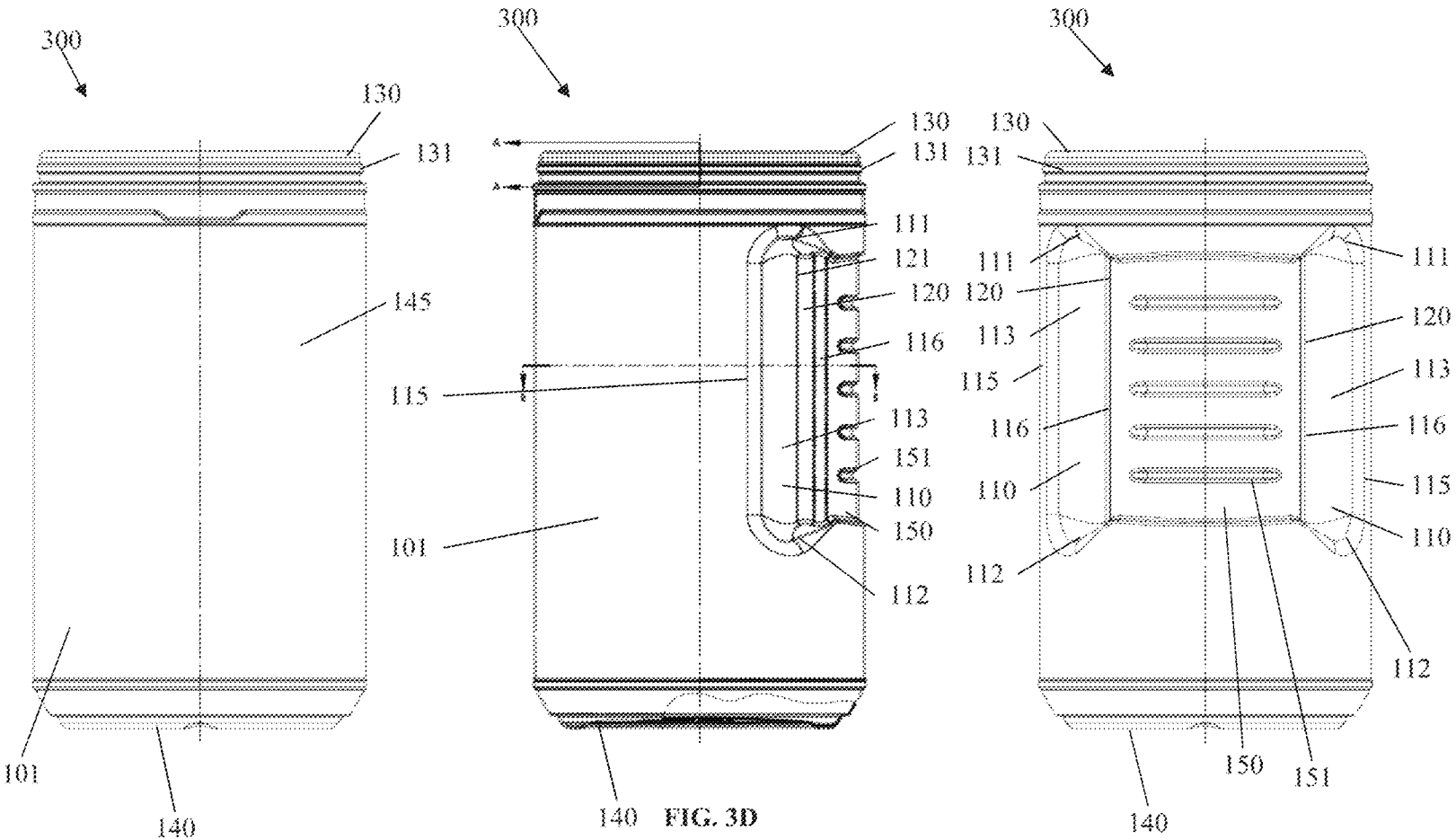
FIG. 3C is a front view of a representative canister of FIG. 3A.
FIG. 3D is a side view of the representative canister of FIG. 3A.
FIG. 3E is a rear view of the representative canister of FIG. 3A.
Figure 3F:
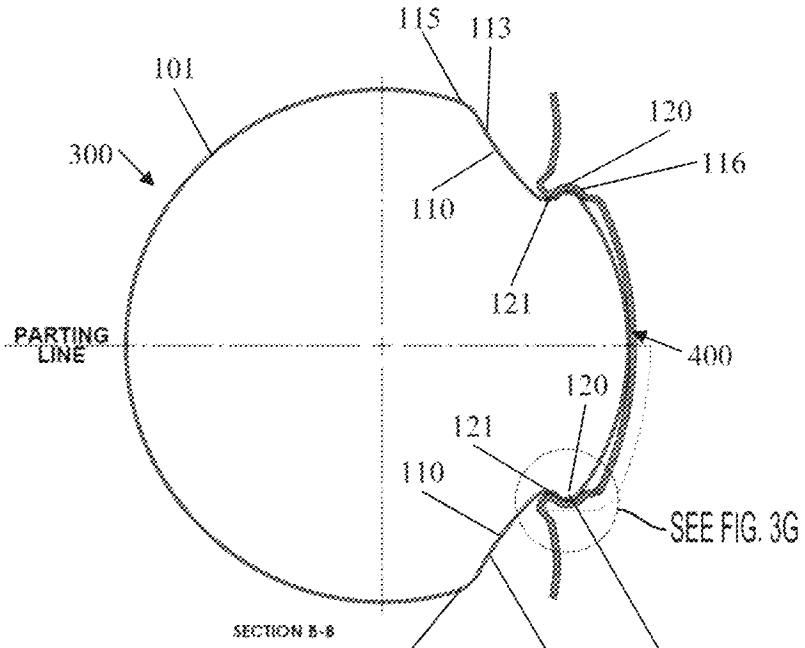
FIG. 3F is a cross-sectional view along the line B-B of the representative canister and bracket of FIG. 3D.
Figure 3G:
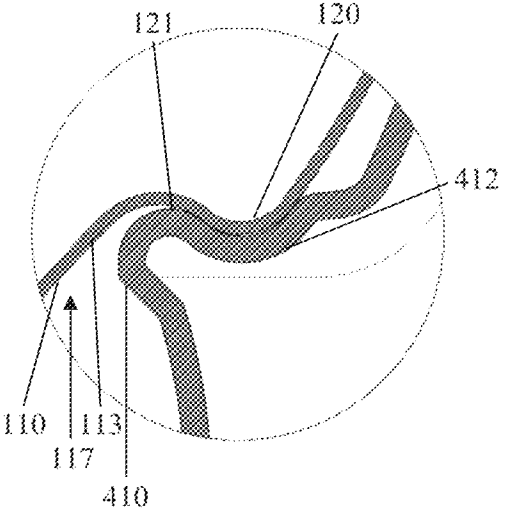
FIG. 3G is a detail view of the section indicated by the circle in FIG. 3F.
Figure 3H:
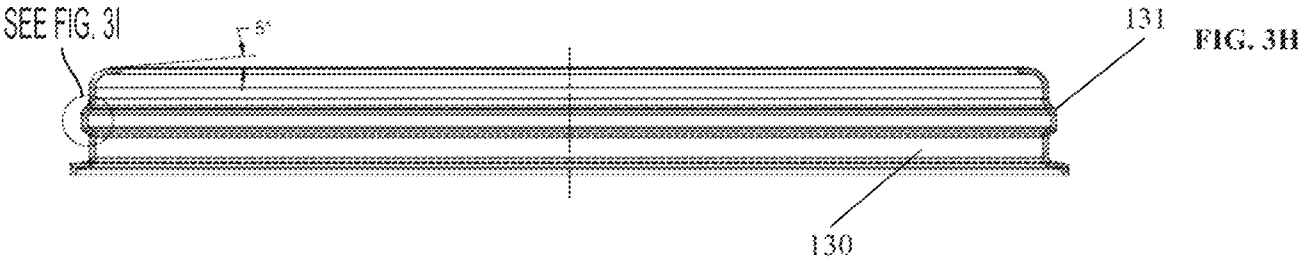
FIG. 3H is a cross-sectional view along the line A-A of the representative canister of FIG. 3D.
Figure 3I:
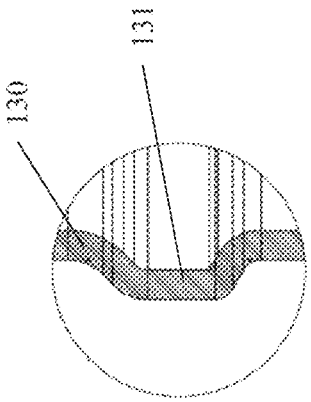
FIG. 3I is a detail view of the section indicated by the circle in FIG. 3H.
Figure 3J:
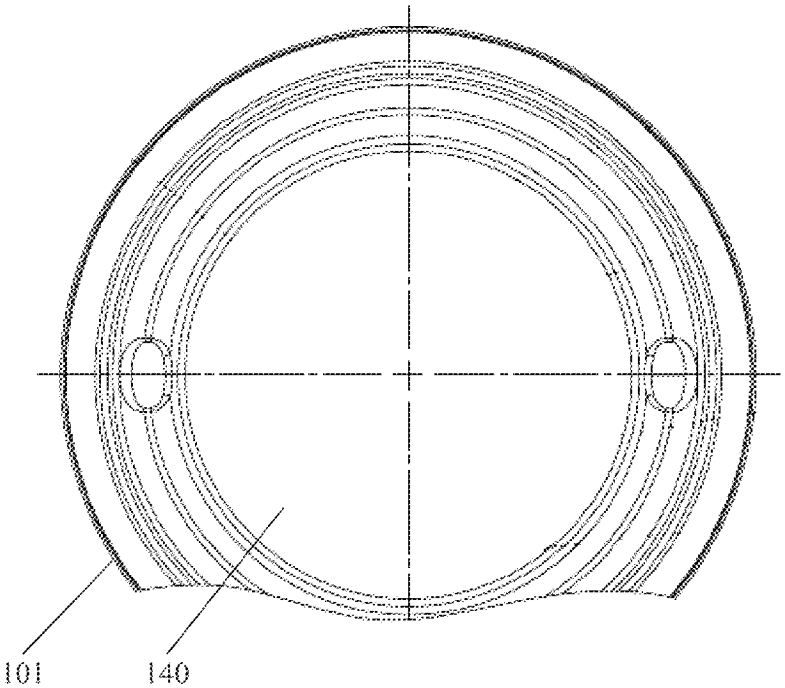
FIG. 3J is an bottom view of the representative canister of FIG. 3A.

As noted herein, the canister 100 of FIG. 1A is similar to the canister 200 of FIG. 2A, but for the dimension of the canister size. Turning to the canister 200 for purposes of explanation, FIG. 2K represents a cross-sectional view of the canister 200 of FIG. 2A, along the line B-B of FIG. 2D. FIG. 2K shows the positioning of the front face 145, rear face 150, first retaining section 110, and second retaining section 110 with respect to the orthogonal axes (transverse axis and longitudinal axis) of the cross-sectional view. The spatial relationships of the canister 200 shown in FIG. 2K further corresponds to the spatial relationships of the similar features of canisters 100, 300. The spatial dimensions of the first retaining section 110 with respect to the axes are shown in FIG. 2K. It is noted that the second retaining section 110 has the same spatial dimensions, but mirrored with respect to the transverse axis.

For each respective retaining section, the front edge 115 and the rear edge 116 of each respective retaining section can be disposed at a minimum of approximately 5 degrees from each other to a maximum of approximately 84 degrees from each other, as shown schematically in FIG. 2K.

The maximum and minimum distance dimensions between the first retaining section and the second retaining section is further shown in FIG. 2K. For example, the front edge 115 of the first retaining section 110 and the front edge 115 of the second retaining section 110 can be disposed from each other up to a minimum of 20 degrees (corresponding to approximately 5 degrees per side with respect to the transverse axis plus the minimum width of 5 degrees of the retaining section per side) along the outer circumferential boundary of the canister, and can be disposed from each other up to a maximum of 178 degrees (corresponding to approximately 89 degrees per side with respect to the transverse axis, inclusive of the minimum width of 5 degrees of the retaining section per side) along the outer circumferential boundary of the canister.

Accordingly, the rear edge 116 of the first retaining section and the rear edge 116 of the second retaining section can be disposed from each other at a minimum of at least 10 degrees (corresponding to 5 degrees per side with respect to the transverse axis) along the outer circumferential boundary of the canister, and can be disposed from each other at a maximum of at least 168 degrees (corresponding to 89 degrees per side with respect to the transverse axis less the minimum width of 5 degrees of the retaining section per side) along the outer circumferential boundary of the canister.

For purposes of example and with respect to the representative canister of FIG. 2K as drawn and embodied herein, the front edges 115 of the first and section retaining sections 110 (shown as letter B) are disposed approximately 140 degrees from each other (corresponding to 70 degrees per side with respect to the transverse axis) along the outer circumferential boundary, which includes 5 degrees width between the front edge 115 and rear edge 116 of each retaining section. Furthermore, the rear edges 116 of the first and second retaining sections 110 (shown at letter A) are disposed approximately 74 degrees apart from each other (corresponding to 37 degrees per side with respect to the transverse axis) along the outer circumferential boundary. The distance dimensions between the front edge 115 of the first retaining section to the front edge 115 of the second retaining section, and between the front edge 115 and rear edge 116 of a given retaining section can vary as desired or needed, e.g., depending on the size of the container 100, 200, 300. The connection between the bracket and the canister being less than 180 degrees (i.e., less than 50% of the distance around the perimeter of the canister) can also allow for a larger branding area of the front face 145 due to additional space available, along with reduce cost of bracket manufacture due to less material of construction than known brackets.

As shown in FIGS. 1A, 1D, and 1E (and correspondingly FIGS. 2A, 2D, 2E, 3A, 3D, and 3E), each retaining section 110 has a top retaining surface 111 surface, a bottom retaining surface 112, and an interior retaining surface 113 disposed between the top and bottom retaining surfaces. The top retaining surface, bottom retaining surface, and the interior retaining surface of each first and second retaining sections are positioned between the front and rear edges 115, 116 of each first and second retaining sections, as shown. The top retaining surface and bottom retaining surface of each respective first and second retaining section engage features of the bracket, as further described herein.

Each respective front edge 115 and the rear edge 116 of the first and second retaining sections defines an indentation 117 therebetween. As shown in the cross-sections of FIGS. 1F and 1G (and FIGS. 2F-2G and 3F-3G), the respective indentations 117 of the retaining sections 110 can be concave when viewed in the horizontal cross section. The indentation includes the interior retaining surface 113 of the respective first and second retaining sections. The first and second retaining sections of the canister respectively include at least one protrusion 120 along the interior surface 113. The at least one protrusion is disposed between the front edge and the rear edge of the respective first and second retaining sections. The at least one protrusion 120 forms a gripping portion 121, which can allow a user to hand carry the container between the thumb and fingers of the user, or which can snap onto the bracket 400, as further discussed herein.

The canister is coupleable with a suitable bracket, as described herein and as shown in FIGS. 1A-1B, 2A-2B, and 3A-3B. Referring also to FIGS. 4A-4E, the bracket comprises a first holding feature 401, a second holding feature 401, and a connection portion 430 that extends between the first holding feature 401 and the second holding feature 401. In coupling the canister and the bracket together, the first holding feature 401 is receivable in the first retaining section 110 of the canister and is releasably engagable with the first retaining section of the canister. The second holding feature 401 is receivable in the second retaining section 110 of the canister and is releasably engagable with the second retaining section of the canister. As such, the first and second holding features 401 are complementary with the first and second retaining sections 110 of the canister. As such, when the bracket is coupled with and supports the canister, the bracket interfaces with less than 180 degrees of the canister about the outer circumferential boundary. The positioning of the first holding feature and the second holding feature of the bracket is dependent upon the same placement of the first and second retaining sections.

The holding features 401 can prevent axial removal of the canister 100 by engaging at least one of the top retaining surface 111 or the bottom retaining surface 112 of the retaining sections 110. As such, the at least one of the top retaining surface or bottom retaining surface of each respective first and second retaining section restricts disengagement of the canister from the bracket. The length of the holding feature is less than the length of the retaining sections of the canister to allow the bracket to fit within the indentation of the canister. Depending on the respective lengths, the fit of the bracket within the indentation can include a tight, approximately flush fit or the fit can have some degree of vertical movement between the canister and the bracket. Depending on the fit, the top of the holding features of the bracket can be the primary support of the top retaining surfaces 111 of the canister. With brackets that have closer tolerances with the retaining sections, both the top and bottom of the holding features of the bracket can together work to support the top retaining surface and the bottom retaining surface of the canister. With some degree of difference in the length of the holding features with respect to the length of the retaining sections, the canister will still easily connect with and disengage with the bracket with a suitable amount of force, as described herein.

Figure 4A:
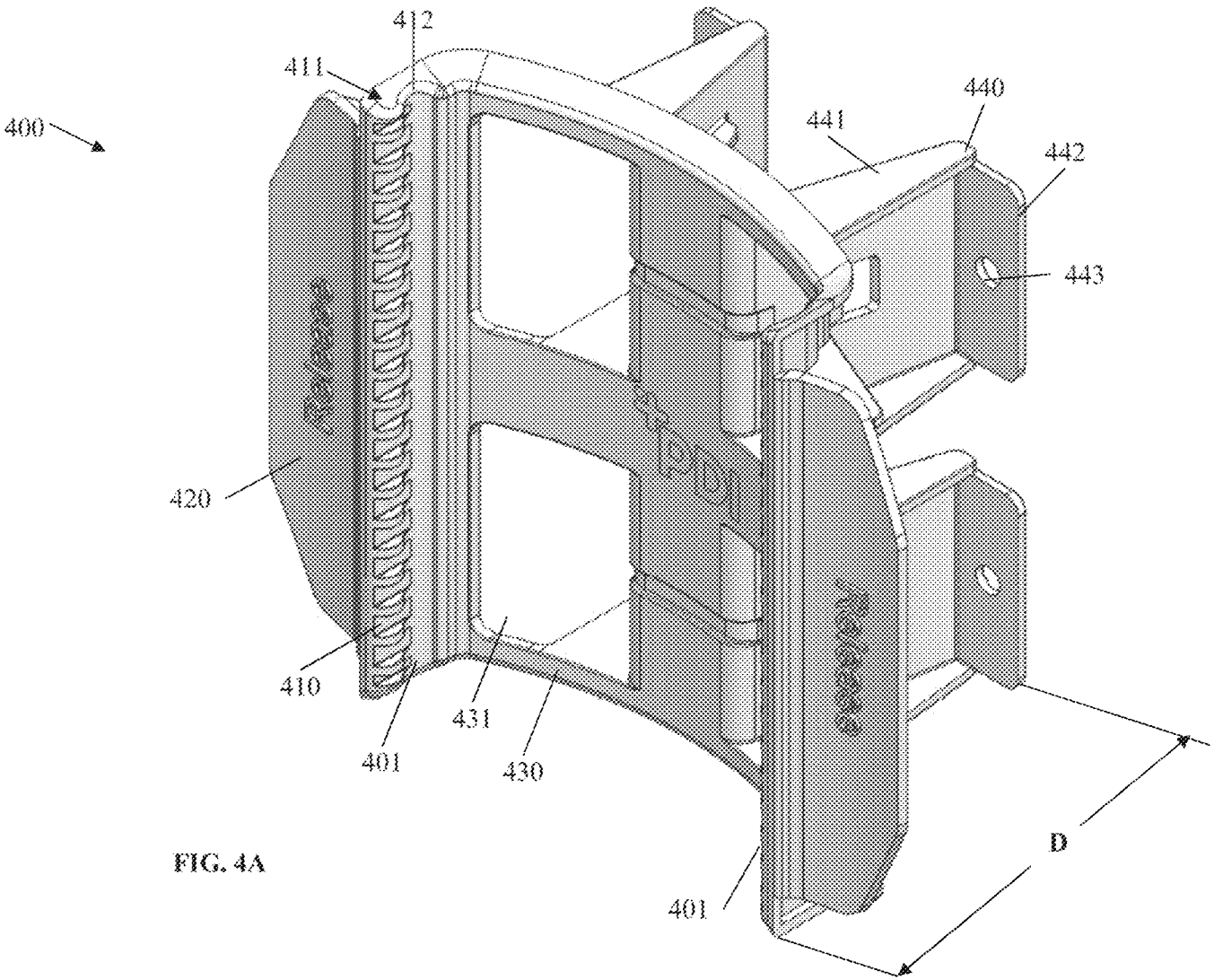
FIG. 4A is a perspective view of a representative bracket according to an illustrative embodiment of the disclosed subject matter.
Figure 4C:
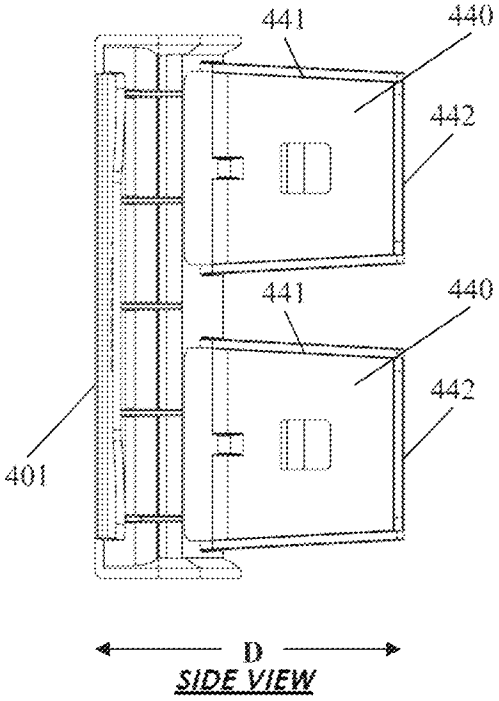
FIG. 4C is a side view of the representative bracket of FIG. 4A.
Figure 4B:
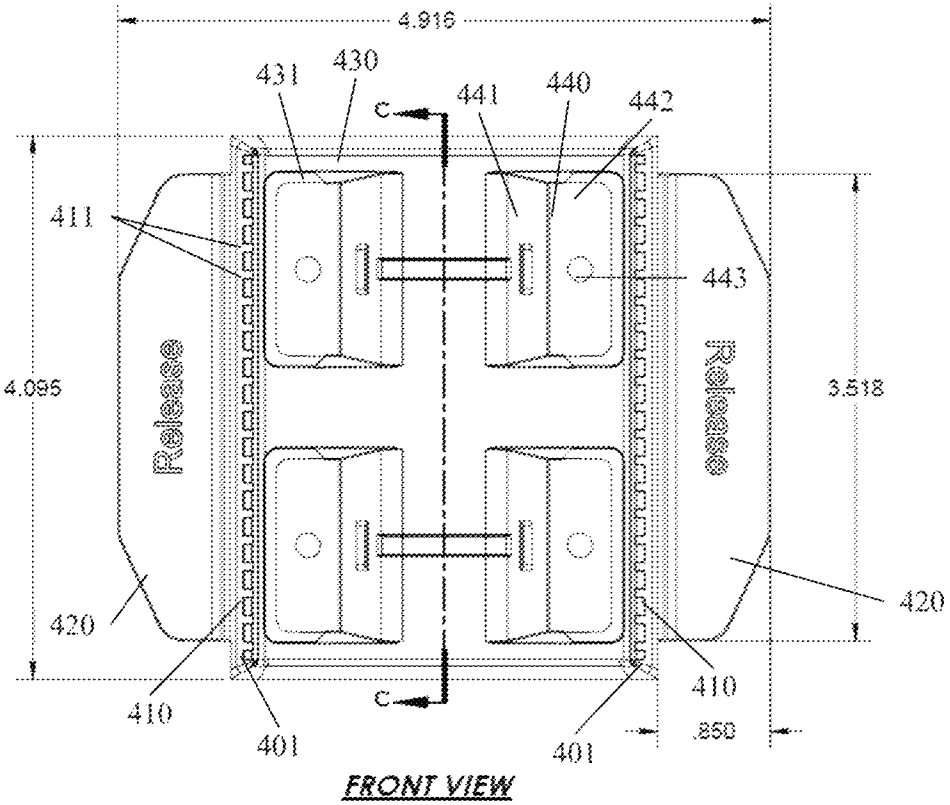
FIG. 4B is a front view of the representative bracket of FIG. 4A.
Figure 4E:
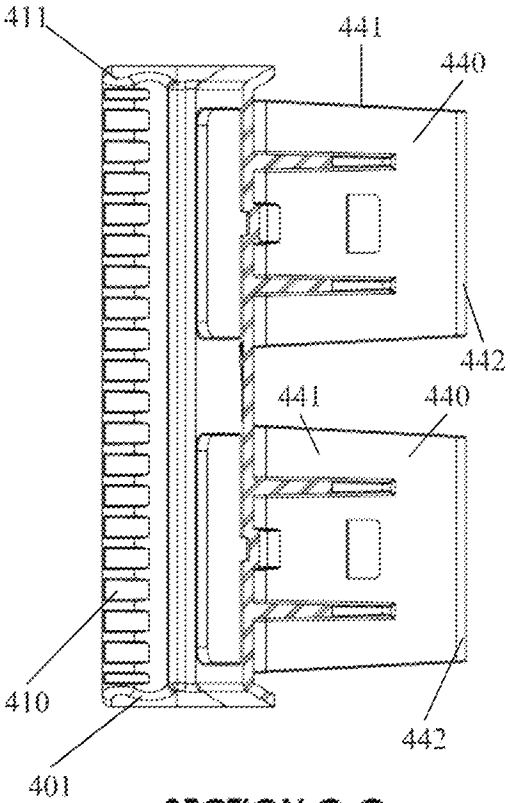
FIG. 4E is a cross-sectional view along the line C-C of the representative bracket of FIG. 4B.
Figure 4D:
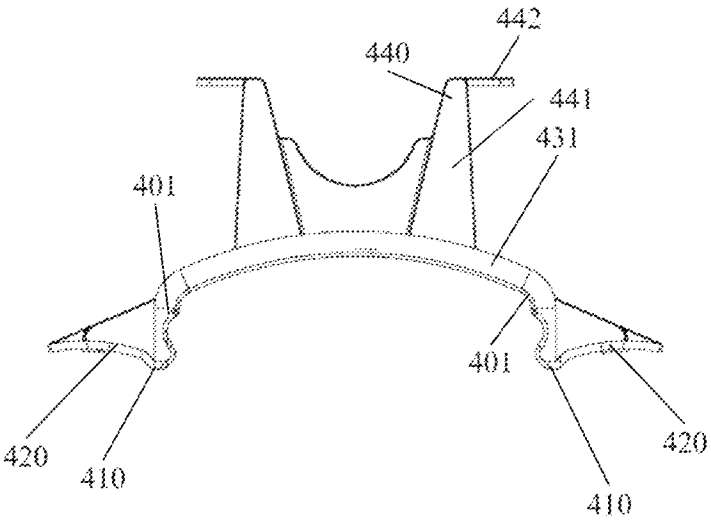
FIG. 4D is a top view of the representative bracket of FIG. 4A.
Figures 5A, 5B, 5C, 5D, 5E, 5F, 5G:
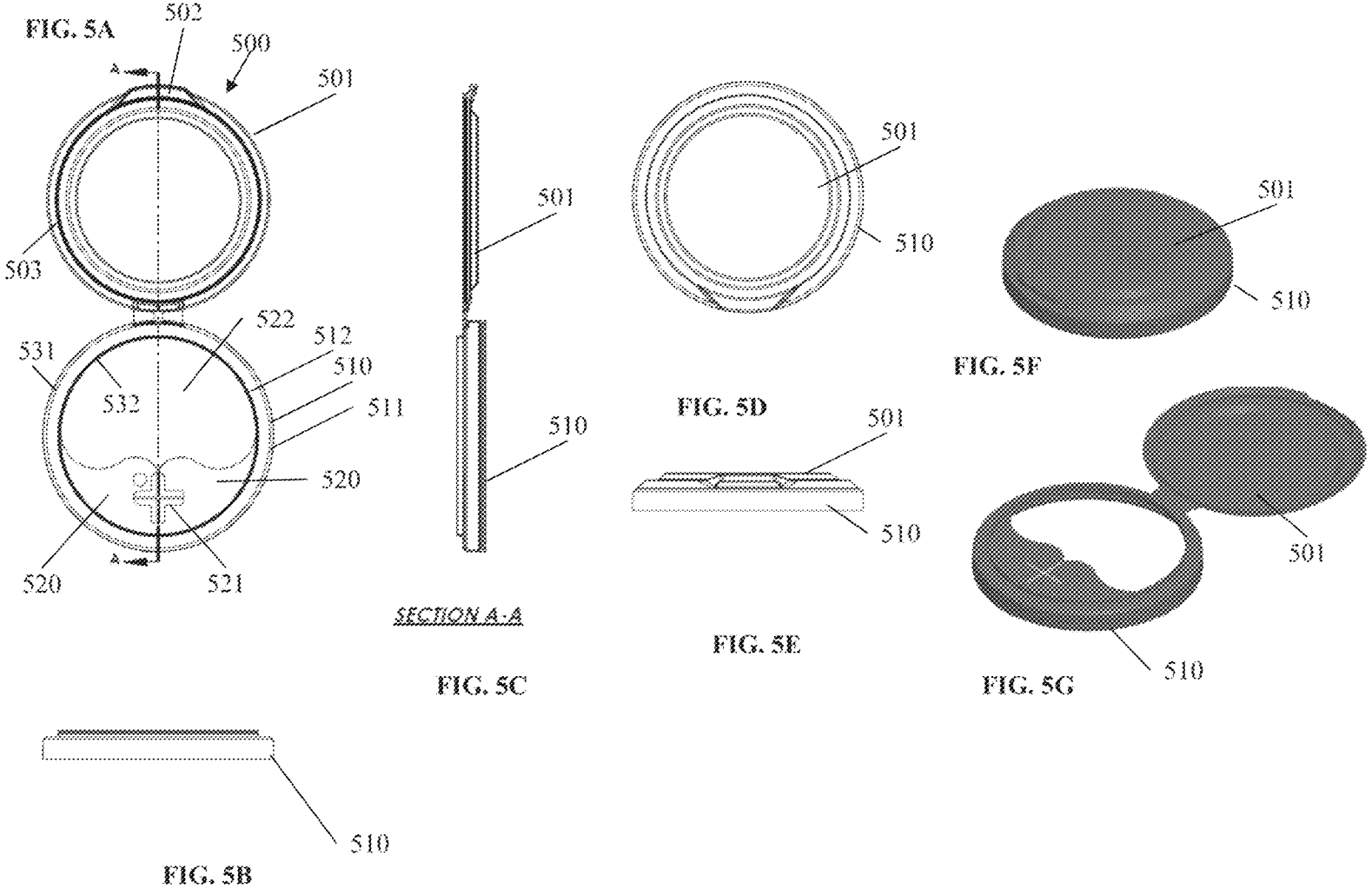
FIG. 5A is a top view of a representative lid in an open configuration according to an illustrative embodiment of the disclosed subject matter.
FIG. 5B is a front view of the representative lid of FIG. 5A in an open configuration.
FIG. 5C is a side view of the representative lid of FIG. 5A.
FIG. 5D is a top view of the representative lid of FIG. 5A in a closed configuration.
FIG. 5E is a front view of the representative lid of FIG. 5A in a closed configuration.
FIG. 5F is a perspective view of the representative lid of FIG. 5A in a closed configuration.
FIG. 5G is a perspective view of the representative lid of FIG. 5A in an open configuration.
Figures 6A, 6B, 6C, 6D, 6E, 6F, 6G:
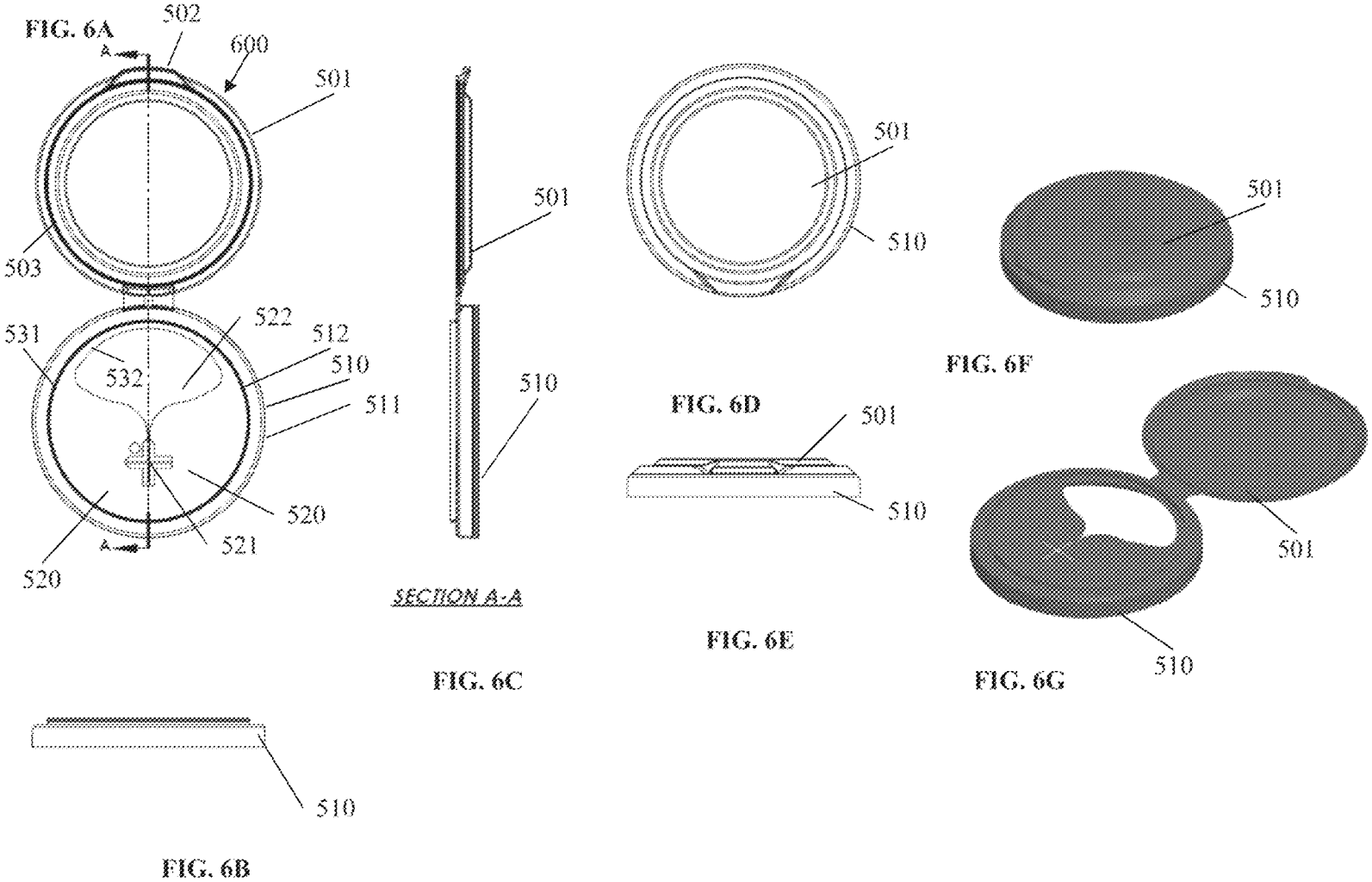
FIG. 6A is a top view of a representative lid in an open configuration according to an illustrative embodiment of the disclosed subject matter.
FIG. 6B is a front view of the representative lid of FIG. 6A in an open configuration.
FIG. 6C is a side view of the representative lid of FIG. 6A.
FIG. 6D is a top view of the representative lid of FIG. 6A in a closed configuration.
FIG. 6E is a front view of the representative lid of FIG. 6A in a closed configuration.
FIG. 6F is a perspective view of the representative lid of FIG. 6A in a closed configuration.
FIG. 6G is a perspective view of the representative lid of FIG. 6A in an open configuration.

As best depicted in FIGS. 4A and 4D, the first holding feature 401 and second holding feature 401 of the bracket each respectively include at least one ridge 410 and at least one abutment surface 412 adjacent thereto. As shown in FIG. 1B and in FIGS. 1F, 1G, 2F, 2G, 3F, and 3G, the at least one ridge 410 is receivable in the indentation 117 of the canister disposed between the front edge 115 and the rear edge 116 of the respective first and second retaining section of the canister. Furthermore, the protrusion 120 of the canister is engageable with the abutment surface 412 of the respective first and second holding feature of the bracket. As shown in the FIG. 4A, each respective ridge can include (e.g., be segmented into) a plurality of teeth 411. Accordingly, the ridge 410 and the plurality of teeth 411 of the bracket 400 can engage the protrusion 120 and gripping portion 121 of the canister. In one embodiment, the canister can include complementary teeth to engage the plurality of teeth of the bracket.

For purpose of illustration and not limitation, the bracket 400 further includes a first tab 420 coupled to the first holding feature 401 and a second tab 420 coupled to the second holding feature 401. When the canister is coupled with the bracket, movement of the first or second tabs 420 away from the canister releases the first holding feature from the first retaining section and releases the second holding feature from the second retaining section to disengage the canister from the bracket. Such movement of the tabs increases the radius of curvature of the abutment surfaces, which allows for the disengagement of the retaining sections from the holding sections to release the canister. Each tab is configured to release the holding feature 401 from the retaining section 110 of the canister upon application of pressure or with respect to an applied force.

The connecting portion 430 of the bracket couples the first and second holding features 401 together. The connecting portion 430 can further define apertures 431 configured to increase flexibility of the bracket. The apertures further allow for reduction of material and can reduce the cost of the bracket.

For example and not limitation, the bracket 400 further can include a fastening portion 440 opposite the first and second holding features to secure the bracket 400 to the further surface, such as a substrate. As depicted in FIG. 4A, the fastening portion 440 comprises at least a first leg 441 with a first foot 442 and at least a second leg 441 with a second foot 442. At least one of the first leg, the first foot, the second leg, and the second foot define an aperture to secure the bracket to a substrate. The first leg 441 can have a first end and a second end. The first leg 441 can be attached at the first end to the connecting portion 430 and can extend away from the connecting portion 430. Additionally, the first leg 441 can be attached to the first foot 442 at the second end thereof. Each foot 442 can extend at an angle to the leg 441. The foot 442 of each respective leg 441 can further define an aperture 443 for receiving a fastener to secure the second member to a substrate. For example and not limitation, the fastener can include one of a nail, a screw, or a bolt.

The first leg is distanced from the second leg at a suitable dimension, as shown in FIG. 4A. As such, the bracket can be coupled to a pole, such as an IV pole, by disposing the pole adjacent the first and second legs. Furthermore, each leg 441 can also define an aperture to receive a zip tie to further secure the bracket to the pole. As embodied herein, the substrate can be any suitable surface, such as a wall, a post, a door, a pole, a cart, or the like.

Additionally, the holding features 401 and retaining sections 110 can be designed such that an amount of force to remove the canister 100 from the bracket 400 is less than an amount of force to remove the bracket 400 from the substrate surface. Accordingly, a minimum predetermined force imposed upon the canister that disengages the canister from the bracket is less than a minimum force required to unsecure the bracket from the substrate. For purpose of illustration and not limitation, the force to initially attach the canister 100 to the bracket 400 can be relatively nominal (e.g., approximately 2-5 lbs.), the force to remove the canister 100 from the bracket 400 can be greater (e.g., approximately 20-40 lbs.), and the force to remove the bracket 400 from the further surface, i.e., substrate, can be greater than such previous force amounts. The actual force to remove the canister 100 from the bracket 400 can vary depending on the materials used therein (i.e. such as dispensing wipes) and the dimensions of the various features of the canister, such as for example, the fasteners/anchors used to secure the bracket 400 to the substrate, the material of the substrate (e.g., Sheetrock®, studs, metal, plywood, or other suitable materials for a wall, a post, a door, or a cart), and the like.

It is appreciated that the bracket according to the disclosed subject matter can be used with a plurality of different devices that include the complementary retaining sections, as described herein. For example, the bracket could be used with a flashlight that includes complementary retaining sections as described herein with respect to the exemplary canister. In one embodiment, the bracket can be used with the containers as described in U.S. Design application No.: 29/520,705, U.S. Design application No. 29/520,713, and U.S. Design application No. 29/520,730, the contents of each of which are incorporated herein by reference in their entireties. Furthermore, the canister according to the disclosed subject matter can be used with different brackets that include complementary holding features.

For example and not limitation, the disclosed subject matter can be used in a fast-paced medical/hospital environments. When medical staff rushing down halls in an emergency situation, the canister and bracket assembly according to the disclosed subject matter can be run into or otherwise disturbed. The disclosed subject matter can allow the canister to disengage from the bracket with less force than that required to remove the bracket from the wall (or a pole, cart, etc.) to which the bracket is mounted. As such, the give and flexibility of the bracket prevents any harm to individuals running into the assembly as the canister pops off the bracket instead of acting as a rigid member potentially harming the individual.

Furthermore, since the bracket can have low side profile, the canister and bracket assembly system can be closer to a wall substrate than other known assemblies. For example and not limitation, the depth dimension of the bracket can be less than 4 inches, less than 2.325 inches in another embodiment, or less than 2.25 inches in a further embodiment. As such, the bracket can have any suitable depth dimension D and profile as needed.

As previously referenced, the canister can further include a lid, as shown in FIGS. 5A-5G and 6A-6G. The lid can be any suitable lid, such as the lid 500 of FIG. 5A and the lid 600 of FIG. 6A. The lid 500, 600 can be attached at the first end of the sidewall 101 of the canister. As embodied herein, the lid 500, 600 can be attached to the finished portion 130 of the canister. For example and not limitation, the representative lid 500 depicted in FIGS. 5A-5G is similar to the lid 600 depicted in FIGS. 6A-6G, except the lids 500, 600 can have different lid surface designs 520 defining the apertures 521, 522, as described herein.

For purpose of illustration and not limitation, each lid 500, 600 can include an annular portion 510 having an outer edge 511, an inner edge 512, an exterior surface 531, and an interior surface 532. For example, the interior surface 532 can engage the ridge 131 of the finished portion 130. Exemplary finished portions are depicted in FIGS. 1H, 2H, 2I, 3H, and 3I. Additionally, or alternatively, each lid 500, 600 can include at least one lid surface design 520 defining a first aperture 522 within the inner edge 512 and a dispensing aperture 521. As embodied herein, each lid 500, 600 further can include a closure portion 501 attached to the exterior surface 531 of the annular portion 510. The closure portion 501 can have a surface feature 503 to engage the annular portion 510. For example, the surface feature 503 can engage the interior surface 532 of the annular portion 510. For purpose of illustration and not limitation, the surface feature 503 can be a ridge, a rim, a protrusion, or a depression.

Additionally or alternatively, each lid 500, 600 can include a tab 502 attached to and extending away from the closure portion 501. The closure portion 501 can cover the first aperture 522 and the dispensing aperture 521 when in the closed configuration (e.g., when the rim 503 engages the annular portion 510). Additionally, the closure portion 501 can be moved to the open configuration to allow access to the first aperture 522 and a the dispensing aperture 521.

FIG. 7 depicts a flow chart illustrating a representative method for releasably mounting a canister with a bracket according to illustrative embodiments of the disclosed subject matter. The method includes providing a canister comprising a sidewall defining a first retaining section and a second retaining section disposed less than 180 degrees from the first retaining section with respect to an outer circumferential boundary of the canister. The method further includes providing a bracket comprising a first holding feature, a second holding feature, and a connection portion that extends between the first holding feature and the second holding feature. The method further includes coupling the canister with the bracket such that the first holding feature is receivable in the first retaining section and is releasably engagable with the first retaining section and the second holding feature is receivable in second retaining section and is releasably engagable with the second retaining section, wherein when the bracket is coupled with and supports the canister the bracket interfaces with than 180 degrees of the canister about the outer circumferential boundary.

The exemplary method of FIG. 7, for purpose of illustration and not limitation, is discussed with reference to the exemplary canisters of the previously disclosed canister and bracket assembly systems. Referring to FIG. 7, at 701, a canister 100 (or 200, 300) is provided. The canister 100 (or 200, 300) can include a sidewall 101 defining two retaining sections 110, as described herein. Each retaining section 110 can have a top retaining surface 111, a bottom retaining surface 112, and an interior retaining surface 113, as described herein. The two retaining sections 110 can be disposed less than 180 degrees along the circumference of the sidewall 101, as described herein.

At 702, a bracket 400 is secured to a further surface, such as a substrate. The bracket 400 can include holding features 401 to releasably engage the interior surfaces 113 of the retaining sections 110, as described herein. The holding features 401 can prevent axial removal of the canister 100 (or 200, 300) by engaging at least one of the top retaining surface 111 or bottom retaining surface 112 of the retaining sections 110 and by allowing the ridge and abutment surfaces of the bracket to interface with the indentation and protrusions of the canister, as described herein.

At 703, the canister 100 (or 200, 300) can be releasably attached to the bracket 400 by engaging the holding features 401 to the interior surfaces 113 of the retaining sections 110, as described herein. As embodied herein, the bracket 400 further can include a connecting portion 430 between the holding features 401, as described herein. Releasably attaching the canister to the bracket can include flexing at least one of the holding features 401 via the tabs and the connecting region 430 to engage the retaining sections 110 with the holding feature 401 of the canister.

As embodied herein, at 704, the canister 100 (or 200, 300) can be optionally released from the bracket 400 with an amount of force less than an amount of force to remove the bracket from the substrate, as described herein. Releasing the canister 100 (or 200, 300) from the bracket can include applying pressure to the tab 420 of the bracket to release and disengage the holding feature 401 from the retaining section 110.

For purpose of illustration and not limitation, the containers and brackets described herein can be formed from any material suitable for containers or brackets including metal, plastic, other polymers, or suitable composite materials. That is, the disclosed subject matter is suitable for a wide variety of containers and brackets. For purpose of illustration and not limitation, a canister can be made up of any suitable material, including, but not limited to, plastic, polymer, composite material, or a combination thereof. As such, the plastic can include high density polyethylene (HDPE), polypropylene (PP), polyethylene terephthalate (PET), low-density polyethylene (LDPE), or linear low-density polyethylene (LLDPE). Additionally, fillers, laminates, or multiple layers can be incorporated into the canister. For example and not limitation, the bracket can be made of any suitable material, including, but not limited to, plastic such as acrylonitrile butadiene styrene (ABS), polystyrene (PS), high-impact polystyrene (HIPS), nylon, polycarbonates (PC), or polyvinyl chloride (PVC).

The canisters and brackets can be formed by any suitable technique, including, but not limited to, blow molding, injection molding, rotational molding, three-dimensional printing/additive manufacturing (AM), thermoforming, and/or compression molding.

In addition to the specific embodiments claimed below, the disclosed subject matter is also directed to other embodiments having any other possible combination of the dependent features claimed below and those disclosed above. As such, the particular features disclosed herein can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed. For example, the canister has been described as circular and tubular with retaining sections spaced at less than 180 degrees for engaging with the bracket. However, the canister may be of other cross sections (e.g., square, elliptical, rectangular etc.) such that the retaining sections and bracket engage at less than 50% of the distance around the canister.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A canister and bracket system, comprising:

a wipes dispensing canister comprising a sidewall defining a first retaining section and a second retaining section disposed less than 180 degrees from the first retaining section with respect to an outer circumferential boundary of the canister; and a bracket having a front side and a back side, the front side of the bracket being attachable with the canister, the front side of the bracket comprising a first holding feature and a second holding feature, wherein a connection portion is coupled to and extends between the first holding feature and the second holding feature, wherein the first holding feature is receivable in the first retaining section and is releasably engagable with the first retaining section of the canister and the second holding feature is receivable in second retaining section and is releasably engagable with the second retaining section of the canister, wherein the back side of the bracket further includes a fastening portion opposite the first and second holding features on the front side, wherein the fastening portion comprises at least a first leg with a first foot angled thereto, and at least a second leg with a second foot angled thereto, wherein the first leg is distanced from the second leg along the connection portion, wherein the first leg and foot and the second leg and foot secure the bracket with a substrate, wherein when the bracket is coupled with and supports the canister, the bracket interfaces with less than 180 degrees of the canister about the outer circumferential boundary, wherein movement of the bracket releases the first holding feature from the first retaining section and releases the second holding feature from the second retaining section to disengage the canister from the bracket.

2. The system of claim 1, wherein the first and second retaining sections of the canister each respectively include a front edge and a rear edge.

3. The system of claim 2, wherein the front edge of the first retaining section is disposed approximately 140 degrees along the outer circumferential boundary from the front edge of the second retaining section and wherein the rear edge of the first retaining section is disposed approximately 74 degrees along the outer circumferential boundary from the rear edge of the second retaining section.

4. The system of claim 2, wherein each of the first and second retaining sections respectively define a top retaining surface, a bottom retaining surface, and an interior retaining surface disposed between the top and bottom retaining surfaces, wherein the top retaining surface, bottom retaining surface, and the interior retaining surface of each first and second retaining sections are positioned between respective front and rear edges of each first and second retaining section.

5. The system of claim 4, wherein at least one of the top retaining surface or bottom retaining surface of each respective first and second retaining section engages the respective first or second holding feature of the bracket, and wherein at least one of the top retaining surface or bottom retaining surface of each respective first and second retaining section restricts disengagement of the canister from the bracket.

6. The system of claim 4, wherein the respective front edge and the rear edge of each first and second retaining section defines an indentation therebetween, the indentation including the interior retaining surface of the respective first and second retaining section.

7. The system of claim 2, wherein each of the first and second retaining sections of the canister respectively include at least one protrusion, wherein the at least one protrusion is disposed between the front edge and the rear edge of the respective first and second retaining sections.

8. The system of claim 7, wherein the first holding feature and second holding feature of the bracket include at least one ridge and at least one abutment surface adjacent thereto, wherein each respective ridge is receivable in a respective indentation between the front edge and the rear edge of each first and second retaining section of the canister, and each protrusion of the canister is engageable with the respective abutment surface of the respective first and second holding feature of the bracket.

9. The system of claim 8, wherein each respective ridge includes a plurality of teeth.

10. The system of claim 1, wherein the bracket further includes a first tab coupled to the first holding feature and a second tab coupled to the second holding feature, wherein movement of the first and second tabs away from the canister releases the first holding feature from the first retaining section and releases the second holding feature from the second retaining section to disengage the canister from the bracket.

11. The system of claim 1, wherein a minimum predetermined force imposed upon the canister that disengages the canister from the bracket is less than a minimum force required to unsecure the bracket from the substrate.

12. The system of claim 1, wherein at least one of the first leg, the first foot, the second leg, and the second foot define an aperture to secure the bracket to the substrate.

13. The system of claim 12, wherein the aperture receives a fastener to secure the bracket to the substrate.

14. The system of claim 13, wherein the fastener comprises at least one of a nail, a screw, a bolt, or zip tie.

15. The system of claim 1, wherein the bracket has a depth dimension less than approximately 4 inches.

16. The system of claim 1, wherein the connection portion defines at least one aperture configured to increase flexibility of the connection portion.

17. The system of claim 1, wherein the canister is made of plastic, polymer, composite material, or a combination thereof.

18. The system of claim 1, wherein the substrate comprises a wall, a post, a door, or a pole.

19. A method for releasably mounting a canister with a bracket, comprising:

providing a wipes dispensing canister comprising a sidewall defining a first retaining section and a second retaining section disposed less than 180 degrees from the first retaining section with respect to an outer circumferential boundary of the canister;

providing a bracket having a front side and a back side, the front side of the bracket comprising a first holding feature and a second holding feature, wherein a connection portion is coupled to and extends between the first holding feature and the second holding feature;

securing the back side of the bracket with a substrate, wherein the back side of the bracket further includes a fastening portion opposite the first and second holding features on the front side, wherein the fastening portion comprises at least a first leg with a first foot angled thereto, and at least a second leg with a second foot angled thereto, wherein the first leg is distanced from the second leg along the connection portion, wherein the first leg and foot and the second leg and foot secure the bracket with a substrate; and coupling the canister with the front side of bracket such that the first holding feature is receivable in the first retaining section and is releasably engagable with the first retaining section and the second holding feature is receivable in second retaining section and is releasably engagable with the second retaining section, wherein when the bracket is coupled with and supports the canister, the bracket interfaces with less than 180 degrees of the canister about the outer circumferential boundary, wherein movement of the bracket releases the first holding feature from the first retaining section and releases the second holding feature from the second retaining section to disengage the canister from the bracket.

20. The method of claim 19, further comprising releasing the canister from the bracket with an amount of force less than an amount of force to remove the bracket from the substrate.

21. The method of claim 20, wherein the first holding feature and the second holding feature each respectively include a first tab and second tab, and wherein releasing the canister from the bracket comprises applying a force to at least one of the first tab or the second tab to release the first holding feature and the second holding feature of the canister from the first retaining section and the second retaining section of the bracket.

* * * * *